US008925913B2

(12) United States Patent
Kubo et al.

(10) Patent No.: US 8,925,913 B2
(45) Date of Patent: Jan. 6, 2015

(54) SHEET CONVEYING DEVICE, IMAGE READING DEVICE, AND IMAGE FORMING APPARATUS

(71) Applicants: Hiroshi Kubo, Kanagawa (JP); Shinya Kitaoka, Kanagawa (JP); Takehisa Shimazu, Kanagawa (JP); Takeshi Akai, Kanagawa (JP); Takuma Ariga, Kanagawa (JP); Fumiyuki Heishi, Kanagawa (JP); Michitaka Suzuki, Kanagawa (JP); Yoshito Suzuki, Kanagawa (JP); Norio Kimura, Kanagawa (JP); Hiroaki Utagawa, Kanagawa (JP); Kenji Hayasaka, Kanagawa (JP); Jun Yamada, Kanagawa (JP); Kenichiro Morita, Tokyo (JP); Ikuhisa Okamoto, Kanagawa (JP); Satoshi Saito, Kanagawa (JP)

(72) Inventors: Hiroshi Kubo, Kanagawa (JP); Shinya Kitaoka, Kanagawa (JP); Takehisa Shimazu, Kanagawa (JP); Takeshi Akai, Kanagawa (JP); Takuma Ariga, Kanagawa (JP); Fumiyuki Heishi, Kanagawa (JP); Michitaka Suzuki, Kanagawa (JP); Yoshito Suzuki, Kanagawa (JP); Norio Kimura, Kanagawa (JP); Hiroaki Utagawa, Kanagawa (JP); Kenji Hayasaka, Kanagawa (JP); Jun Yamada, Kanagawa (JP); Kenichiro Morita, Tokyo (JP); Ikuhisa Okamoto, Kanagawa (JP); Satoshi Saito, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/905,245

(22) Filed: May 30, 2013

(65) Prior Publication Data

US 2013/0320611 A1 Dec. 5, 2013

(30) Foreign Application Priority Data

Jun. 1, 2012 (JP) ..... 2012-126589

(51) Int. Cl.
*B65H 3/06* (2006.01)

(52) U.S. Cl.
CPC ..... *B65H 3/0615* (2013.01); *B65H 2801/39* (2013.01); *B65H 3/0684* (2013.01); *B65H 2801/06* (2013.01); *B65H 2404/623* (2013.01); *B65H 2511/521* (2013.01); *B65H 2402/44* (2013.01)
USPC ..... 271/117; 271/118

(58) Field of Classification Search
USPC ..... 271/109, 117, 118
See application file for complete search history.

(56) References Cited

U.S. PATENT DOCUMENTS

| | | | | |
|---|---|---|---|---|
| 5,887,866 | A * | 3/1999 | Yamauchi et al. | 271/116 |
| 7,766,319 | B2 * | 8/2010 | Miyamoto et al. | 271/117 |
| 7,980,549 | B2 * | 7/2011 | Hamaguchi | 271/118 |
| 8,047,531 | B1 * | 11/2011 | Liao et al. | 271/117 |
| 8,201,817 | B1 * | 6/2012 | Boo | 271/10.13 |
| 8,201,820 | B2 * | 6/2012 | Lu et al. | 271/117 |
| 8,313,097 | B2 * | 11/2012 | Kayama | 271/117 |
| 8,376,350 | B2 * | 2/2013 | Choi | 271/117 |
| 2005/0194733 | A1 * | 9/2005 | Asada | 271/117 |
| 2011/0241282 | A1 * | 10/2011 | Nishinakama et al. | 271/117 |
| 2012/0074636 | A1 * | 3/2012 | Choi | 271/3.18 |

FOREIGN PATENT DOCUMENTS

JP H10-109773 4/1998

* cited by examiner

*Primary Examiner* — Kaitlin Joerger
(74) *Attorney, Agent, or Firm* — Harness, Dickey & Pierce P.L.C.

(57) ABSTRACT

A sheet conveying device such as a feed mechanism includes a pick-up roller and a cover member. The pick-up roller feeds, into an apparatus, a sheet such as a document on a placing table such as a document placing table on which the sheet is placed. The cover member such as a pick-up cover covers the pick-up roller. The cover member is supported at both ends thereof on a shaft of the pick-up roller or on shaft bearings that receive the shaft of the pick-up roller.

24 Claims, 12 Drawing Sheets

SHEET CONVEYING DEVICE, IMAGE READING DEVICE, AND IMAGE FORMING APPARATUS

CROSS-REFERENCE TO RELATED APPLICATIONS

The present application claims priority to and incorporates by reference the entire contents of Japanese Patent Application No. 2012-126589 filed in Japan on Jun. 1, 2012.

BACKGROUND OF THE INVENTION

1. Field of the Invention

The present invention relates to a sheet conveying device that conveys sheets, an image reading device, and an image forming apparatus.

2. Description of the Related Art

Japanese Patent Application Laid-open No. H10-109773 describes a sheet conveying device that conveys, using a pick-up roller, a plurality of sheets of a sheet bundle, such as a document bundle or a recording sheet bundle, stacked on a placing table to a separation nip forming a contact portion of a feed roller and a reverse roller, then separates the sheets into each single sheet using the feed roller and the reverse roller, and conveys the sheet into an apparatus.

FIG. 20 is a schematic configuration diagram of a sheet conveying device 300 described in Japanese Patent Application Laid-open No. H10-109773, and FIG. 21 is a plan view of the sheet conveying device 300 described in Japanese Patent Application Laid-open No. H10-109773.

As illustrated in FIG. 21, the sheet conveying device 300 is disposed in a cutout space 321 of a housing 320 on a body of the apparatus. A pick-up roller 322 is fixed to a pick-up shaft 326 supported as a cantilever by a pick-up swing bracket 325. A feed roller 323 is fixed to a feed shaft 327 supported as a cantilever by the apparatus body. As illustrated in FIG. 20, a reverse roller 324 is supported in the apparatus body, and is in contact with the feed roller 323 to form the separation nip.

The sheet conveying device 300 is also provided with a cover member 302 covering the pick-up roller 322 and the feed roller 323. The cover member 302 is supported, on one end side in the pick-up shaft direction thereof, as a cantilever by free ends (on the left side of FIG. 21) of the pick-up shaft 326 and the feed shaft 327.

As illustrated in FIG. 20, the cover member 302 includes an arc-shaped portion 303 that almost fully covers a side toward a placing table 330 of the outer circumference of the pick-up roller 322.

The conventional sheet conveying device 300 illustrated in FIGS. 20 and 21 has the configuration in which the cover member 302 is supported as a cantilever, and thus, the own weight of the cover member 302 or an error in mounting of the cover member 302 to the pick-up shaft 326 and the feed shaft 327 can cause the free end side (right side of FIG. 21) of the cover member 302 to come in contact with the uppermost sheet of the sheet bundle on the placing table 330. As a result, during the conveyance of sheets, the uppermost sheet of the sheet bundle on the placing table 330 can brush against the cover member 302 to be damaged. Also, an increase in conveying load of the sheet on the side of the cover member 302 can cause a conveyance trouble or a skew to occur.

Therefore, to prevent the free end side (right side of FIG. 21) of the cover member 302 from coming in contact with the uppermost sheet of the sheet bundle on the placing table 330 even when the mounting error exists, it is conceivable to set the cover member 302 and the placing table 330 to have a large clearance therebetween. In this case, however, the following problem occurs. Specifically, in a configuration in which the placing table 330 is exposed out of the apparatus, a user may temporarily place an object, such as a necklace or a ruler, other than the sheet (hereinafter called a foreign object) on top of the sheet bundle on the placing table 330. If the user starts the conveyance of sheets without remembering having placed the foreign object on top of the sheet bundle, the foreign object on top of the sheet bundle is conveyed into the apparatus together with the uppermost sheet. At this time, if the clearance between the cover member 302 and the placing table 330 is large, the cover member 302 cannot block the foreign object having a small height like the necklace or the ruler, and thus, the foreign object is conveyed into the apparatus. The problem, thus, is that the foreign object conveyed into the apparatus can damage or break the pick-up roller 322 and/or other parts.

Therefore, it is desirable to provide a sheet conveying device, a document feeder, and an image forming apparatus in which a cover member can keep foreign objects other than a sheet on a placing table from entering the apparatus so as to keep parts in the apparatus from being broken, while keeping from coming in contact with the sheet.

SUMMARY OF THE INVENTION

It is an object of the present invention to at least partially solve the problems in the conventional technology.

According to an aspect of the present invention, there is provided a sheet conveying device including: a pick-up roller that feeds, into an apparatus, a sheet on a placing table on which the sheet is placed; and a cover member that covers the pick-up roller, wherein the cover member is supported at both ends thereof on a shaft of the pick-up roller or on shaft bearings that receive the shaft of the pick-up roller.

According to another aspect of the present invention, there is provided an image reading device including: a document placement unit; and a conveying unit that conveys a document on the document placement unit through a document read position of a document reading unit toward a destination of conveyance, wherein the conveying unit includes: a pick-up roller that feeds, into an apparatus, a sheet on a placing table on which the sheet is placed; and a cover member that covers the pick-up roller, wherein the cover member is supported at both ends thereof on a shaft of the pick-up roller or on shaft bearings that receive the shaft of the pick-up roller.

According to still another aspect of the present invention, there is provided An image forming apparatus including: an image reading unit that reads an image on a document while conveying the document; and an image forming unit that forms the image read by the image reading unit on a recording material, wherein the image reading unit includes: a document placement unit; and a conveying unit that conveys a document on the document placement unit through a document read position of a document reading unit toward a destination of conveyance, wherein the conveying unit includes: a pick-up roller that feeds, into an apparatus, a sheet on a placing table on which the sheet is placed; and a cover member that covers the pick-up roller, wherein the cover member is supported at both ends thereof on a shaft of the pick-up roller or on shaft bearings that receive the shaft of the pick-up roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A description will be made below of an embodiment in which the present invention is applied to an electrophotographic copier (hereinafter called simply a copier).

Figure 1:
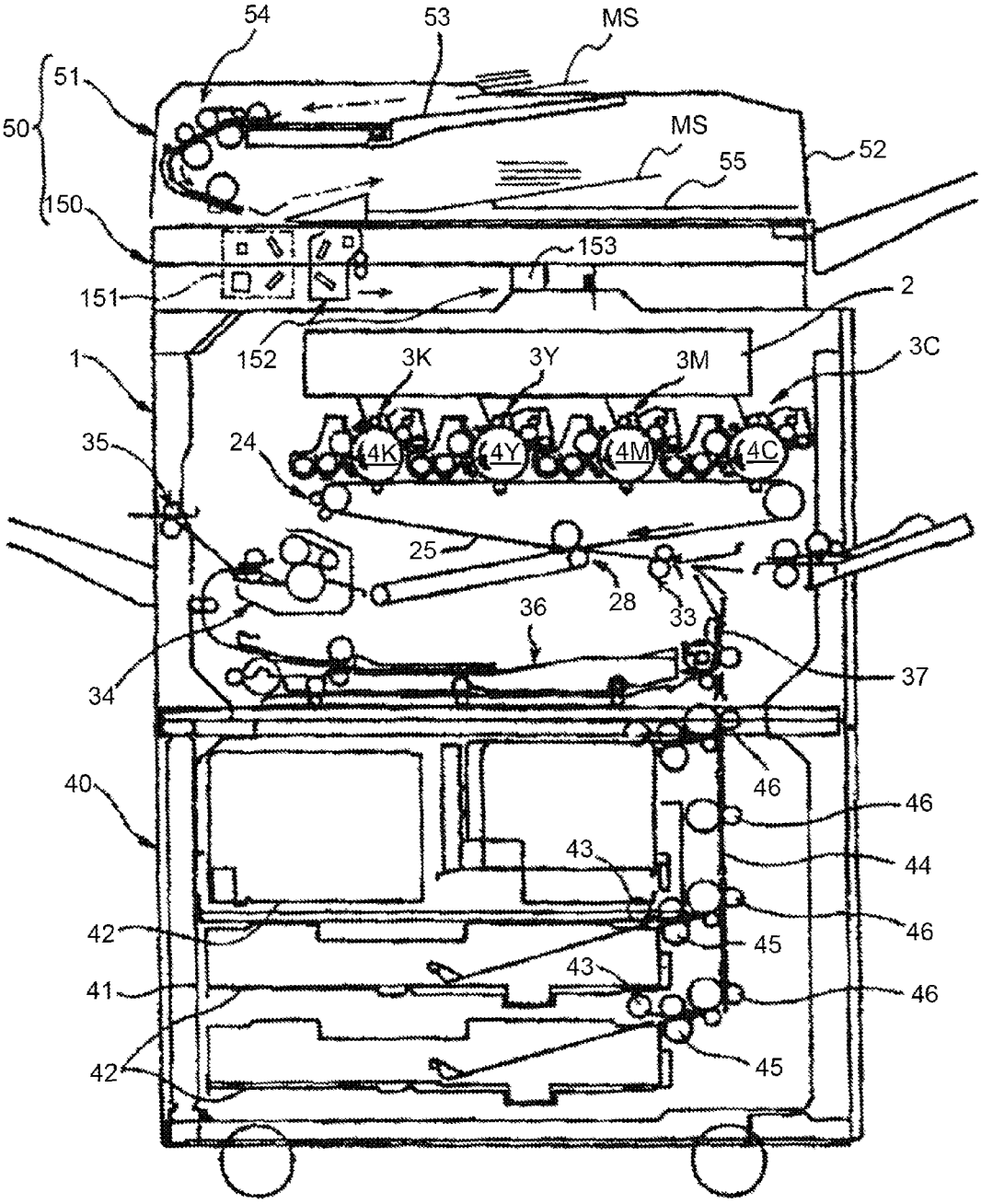
FIG. 1 is a schematic configuration diagram illustrating a copier according to an embodiment of the present invention.

First, a basic configuration of the copier according to the embodiment will be described. FIG. 1 is a schematic configuration diagram illustrating the copier according to the embodiment. This copier is provided with an image forming unit 1, a blank sheet feeding device 40, and a document feeding/reading unit 50. The document feeding/reading unit 50 serving as a document reading device includes a scanner 150 fixed on top of the image forming unit 1 and an ADF 51 serving as a document feeder supported by the scanner 150.

The blank sheet feeding device 40 includes two paper cassettes 42 arranged in multiple stages in a paper bank 41, feed-out rollers 43 that feed transfer sheets out of the paper cassettes, separation rollers 45 that separate the fed-out transfer sheets and feed them to a paper feed path 44. The blank sheet feeding device 40 also includes a plurality of carriage rollers 46 that convey the transfer sheets to a paper feed path 37 of the image forming unit 1. Thus, the blank sheet feeding device 40 feeds the transfer sheets from inside the paper cassettes to the paper feed path 37 in the image forming unit 1.

Figure 2:
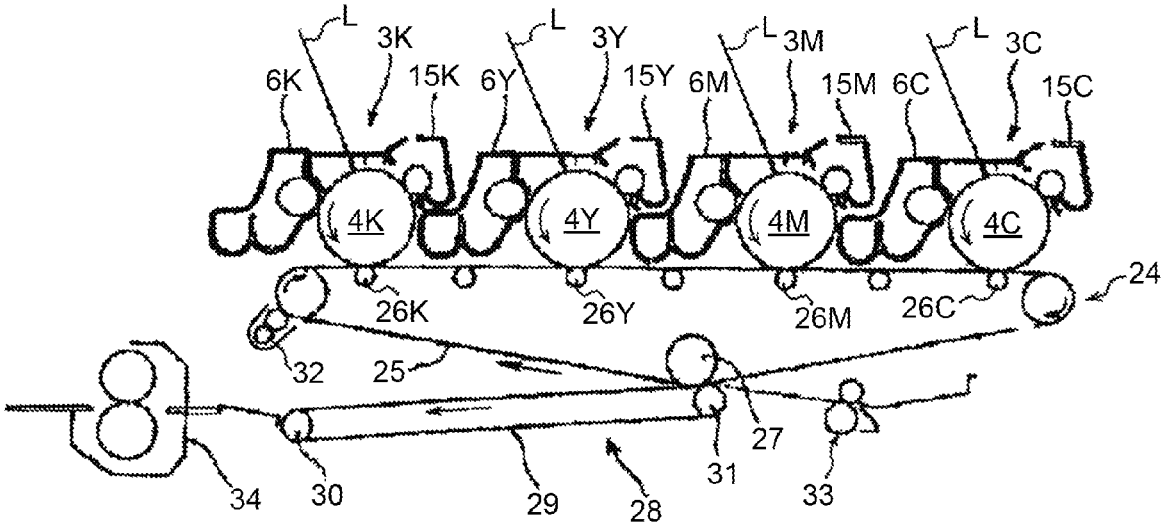
FIG. 2 is a partial enlarged configuration diagram illustrating a part of an internal configuration of an image forming unit in the copier in an enlarged scale.

FIG. 2 is a partial enlarged configuration diagram illustrating a part of an internal configuration of the image forming unit in an enlarged scale. The image forming unit 1 serving as an image forming unit is provided with an optical writing device 2, four process units 3K, 3Y, 3M, and 3C that form toner images having colors of K, Y, M, and C, respectively, a transfer unit 24, a sheet conveying unit 28, a pair of registration rollers 33, a fixing device 34, a switchback device 36, the paper feed path 37, and so on. The image forming unit 1 drives light sources, such as laser diodes or light emitting diodes (LEDs) (not illustrated), arranged in the optical writing device 2 to emit laser beams L toward four drum-like photosensitive elements 4K, 4Y, 4M, and 4C. This laser beam emission forms electrostatic latent images on the surfaces of the photosensitive elements 4K, 4Y, 4M, and 4C, and the latent images are developed into toner images through a predetermined developing process. Note that the suffixes K, Y, M, and C affixed to the ends of reference numerals indicate specifications for black, yellow, magenta, and cyan, respectively.

Each of the process units 3K, 3Y, 3M, and 3C supports the photosensitive element and various devices arranged therearound as one unit on a common supporting member, and is mountable to and removable from a body of the image forming unit 1. For example, the process unit 3K for black includes, in addition to the photosensitive element 4K, a developing device 6K for developing the electrostatic latent image formed on the surface of the photosensitive element 4K into a black toner image. The process unit 3K also includes a drum cleaning device 15 that cleans off a remaining post-transfer toner attached on the surface of the photosensitive element 4K after passing through a primary transfer nip for K to be described later. This copier has a commonly called tandem configuration in which the four process units 3K, 3Y, 3M, and 3C are disposed opposite to an intermediate transfer belt 25, to be described later, so as to be arranged along the endlessly moving direction thereof.

Figure 3:
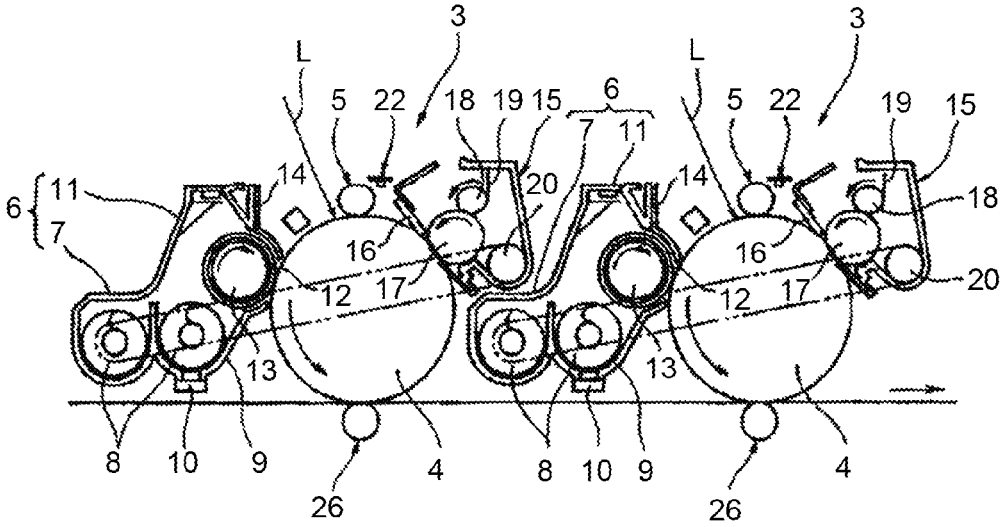
FIG. 3 is a partial enlarged diagram illustrating a part of a tandem unit composed of four process units in the image forming unit.

FIG. 3 is a partial enlarged diagram illustrating a part of the tandem unit composed of the four process units 3K, 3Y, 3M, and 3C. Note that the four process units 3K, 3Y, 3M, and 3C have almost equal configurations except using toners of different colors from each other, and thus, the suffixes K, Y, M, and C affixed to the respective reference numerals are omitted in FIG. 3. As illustrated in FIG. 3, each of the process units 3 includes a charging device 23, the developing device 6, the drum cleaning device 15, and a neutralization lamp 22 around the photosensitive element 4.

The photosensitive element 4 uses a drum-like member made of an element tube of aluminum or the like on which a photosensitive layer is formed by applying an organic photosensitive material having photosensitivity. The photosensitive element 4 may instead use an endless belt-like member.

The developing device 6 develops the latent image using a two-component developer containing a magnetic carrier and a nonmagnetic toner (not illustrated). The developing device 6 includes a stirring unit 7 that conveys, while stirring, the two-component developer contained therein and supplies the developer to a developing sleeve 12, and a developing unit 11 for transferring the toner in the two-component developer carried on the developing sleeve 12 to the photosensitive element 4.

The stirring unit 7 is provided at a position lower than the developing unit 11, and includes two conveying screws 8 arranged in parallel with each other, a partition plate provided between the screws, and a toner concentration sensor 10 provided on the bottom surface of a developing case 9.

The developing unit 11 includes the developing sleeve 12 facing the photosensitive element 4 through an opening of the developing case 9, a magnetic roller 13 nonrotatably provided inside of the developing sleeve 12, and a doctor blade 14 that brings an end thereof close to the developing sleeve 12. The developing sleeve 12 is a nonmagnetic rotatable cylindrical sleeve. The magnetic roller 13 has a plurality of magnetic poles sequentially arranged from a position facing the doctor blade 14 toward the direction of rotation of the sleeve. Each of these magnetic poles applies a magnetic force to the two-component developer on the developing sleeve in a predetermined position in the direction of rotation. This causes the two-component developer fed from the stirring unit 7 to be attracted to the surface of the developing sleeve 12 and carried thereon, and forms a magnetic brush along magnetic field lines on the surface of the sleeve.

As the developing sleeve 12 rotates, the magnetic brush is restricted to have an appropriate layer thickness at the time of passing through the position facing the doctor blade 14, and then conveyed to a developing area facing the photosensitive element 4. The magnetic brush then transfers the toner onto the electrostatic latent image by using a potential difference between a developing bias applied to the developing sleeve 12 and the electrostatic latent image on the photosensitive element 4 so as to contribute to the development. The magnetic brush returns again into the developing unit 11 as the developing sleeve 12 further rotates, and, after being separated from the surface of the sleeve due to an effect of a repulsive magnetic field formed between the magnetic poles of the magnetic roller 13, is returned to the stirring unit 7. An appropriate amount of the toner is replenished to the two-component developer in the stirring unit 7 based on a detection result by the toner concentration sensor 10. The developing device 6 may employ a type that uses a one-component developer containing no magnetic carrier, instead of the type that uses two-component developer.

While the drum cleaning device 15 uses a technique for pressing a cleaning blade 16 made of polyurethane rubber against the photosensitive element 4, any other technique may be used. For the purpose of enhancing cleaning performance, the present embodiment employs a system that includes a contact conductive fur brush 17 with the outer circumferential surface thereof contacting the photosensitive element 4 in a manner rotatable in the direction of an arrow in FIG. 3. The fur brush 17 also scrapes off a lubricant from a solid lubricant (not illustrated) to make the lubricant a fine powder and applies it onto the surface of the photosensitive element 4. A metal electric field roller 18 that applies a bias to the fur brush 17 is rotatably provided in the direction of an arrow in FIG. 3, and an end of a scraper 19 is pressed against the electric field roller 18. The toner attached on the fur brush 17 is transferred to the electric field roller 18 to which the bias is applied, while the electric field roller 18 rotates in the counter direction against the fur brush 17 in contact with it. The toner is then scraped off by the scraper 19 from the electric field roller 18, and thereafter falls onto a recovery screw 20. The recovery screw 20 conveys the recovered toner toward an end of the drum cleaning device 15 in the direction perpendicular to the plane of FIG. 3, and transfers the recovered toner to an external recycle conveying device 21. The recycle conveying device 21 feeds the transferred toner to the developing device 6 to recycle the toner.

The neutralization lamp 22 neutralizes the photosensitive element 4 using light irradiation. The surface of the neutralized photosensitive element 4 is uniformly charged by the charging device 23, and then is subjected to an optical writing process by the optical writing device 2. The charging device 23 uses a type that rotates a charging roller to which a charging bias is applied while keeping the charging roller in contact with the photosensitive element 4. A scorotron charger may be used that charges the photosensitive element 4 in a contactless manner.

In FIG. 2 exhibited above, K, Y, M, and C toner images are respectively formed by the process described above on the photosensitive elements 4K, 4Y, 4M, and 4C of the four process units 3K, 3Y, 3M, and 3C.

The transfer unit 24 is disposed below the four process units 3K, 3Y, 3M, and 3C. The transfer unit 24 endlessly moves the intermediate transfer belt 25 looped in a tensioned state over a plurality of rollers in the clockwise direction in FIG. 2 while keeping the belt 25 in contact with the photosensitive elements 4K, 4Y, 4M, and 4C. This forms primary transfer nips for K, Y, M, and C at which the photosensitive elements 4K, 4Y, 4M, and 4C come in contact with the intermediate transfer belt 25. Primary transfer rollers 26K, 26Y, 26M, and 26C arranged inside the belt loop press the intermediate transfer belt 25 against the photosensitive elements 4K, 4Y, 4M, and 4C near the primary transfer nips for K, Y, M, and C. A power source (not illustrated) applies a primary transfer bias to each of the primary transfer rollers 26K, 26Y, 26M, and 26C. This causes the primary transfer nips for K, Y, M, and C to form primary transfer electric fields that electrostatically move the toner images on the photosensitive elements 4K, 4Y, 4M, and 4C toward the intermediate transfer belt 25. The toner images are primarily transferred at the respective primary transfer nips so as to be sequentially superimposed on each other onto the outer surface of the intermediate transfer belt 25 that sequentially passes through the primary transfer nips for K, Y, M, and C along with the endless movement in the clockwise direction in FIG. 2. This superimposed primary transfer forms a toner image of four superimposed colors (hereinafter called a four-color toner image) on the outer surface of the intermediate transfer belt 25.

The sheet conveying unit 28 is provided below the transfer unit 24 in FIG. 2, and includes an endless sheet conveying belt 29 stretched between a driving roller 30 and a secondary transfer roller 31 to make endless movement. The intermediate transfer belt 25 and the sheet conveying belt 29 are nipped between the secondary transfer roller 31 of the sheet conveying unit 28 and a lower tension roller 27 of the transfer unit 24. This forms a secondary transfer nip at which the outer surface of the intermediate transfer belt 25 comes in contact with the outer surface of the sheet conveying belt 29. A power source (not illustrated) applies a secondary transfer bias to the secondary transfer roller 31. The lower tension roller 27 of the transfer unit 24 is grounded. As a result, a secondary transfer electric field is formed at the secondary transfer nip.

The registration rollers 33 are disposed on the right side in FIG. 2 of the secondary transfer nip, and feeds out the transfer sheet nipped between the rollers to the secondary transfer nip at the timing at which the transfer sheet can be synchronized with the four-color toner image on the intermediate transfer belt 25. The four-color toner image on the intermediate transfer belt 25 is secondarily transferred en bloc onto the transfer sheet in the secondary transfer nip by effects of the secondary transfer electric field and a nip pressure, and is combined with white of the transfer sheet to be formed into a full-color image. The transfer sheet having passed through the secondary transfer nip is separated from the intermediate transfer belt 25, and, while being held on the outer surface of the sheet conveying belt 29, is conveyed to the fixing device 34 as the belt 29 endlessly moves.

A remaining post-transfer toner that has not been transferred to the transfer sheet at the secondary transfer nip is attached on the surface of the intermediate transfer belt 25 that has passed through the secondary transfer nip. This remaining post-transfer toner is scraped off and removed by a belt cleaning device contacting the intermediate transfer belt 25.

The full-color image is fixed to the transfer sheet conveyed to the fixing device 34 by pressure and heat in the fixing device 34. Thereafter, the transfer sheet is fed from the fixing device 34 to a pair of ejecting rollers 35, and then is ejected out of the apparatus.

In FIG. 1 exhibited above, the switchback device 36 is disposed below the sheet conveying unit 28 and the fixing device 34. With this arrangement, the transfer sheet after being subjected to the image fixing process for one surface thereof is switched in the course thereof toward a transfer sheet reversing device by a switching claw, and is flipped over at the transfer sheet reversing device to enter the secondary transfer nip again. Then, the secondary transfer process and the fixing process of the image are also applied to the other surface of the transfer sheet, which is then discharged onto a discharge tray.

The scanner 150 fixed on the image forming unit 1 includes a first-surface fixed scanning unit 151 serving as a first-surface scanning unit and a movable scanning unit 152 serving as a first-surface scanning unit.

The movable scanning unit 152 as the first-surface scanning unit is disposed immediately below a second contact glass (not illustrated) that is fixed on an upper wall of a casing of the scanner 150 so as to be in contact with a document MS, and can move an optical system composed of a light source, reflecting mirrors, and the like in the right and left directions in FIG. 1. In the process of moving the optical system from left to right in FIG. 1, light emitted from the light source is reflected on the document (not illustrated) placed on the second contact glass, and then, after being reflected on the reflecting mirrors, received by an image reading sensor 153 fixed to a body of the scanner.

The first-surface fixed scanning unit 151 as the first-surface scanning unit is disposed immediately below a first contact glass (not illustrated) that is fixed on the upper wall of the casing of the scanner 150 so as to be in contact with the document MS. When the document MS conveyed by the ADF 51 to be described later passes on the first contact glass, light emitted from a light source is sequentially reflected on the surface of the document, and after being reflected on a plurality of reflecting mirrors, received by the image reading sensor. This causes a first surface of the document MS to be scanned without moving an optical system composed of the light source and the reflecting mirrors.

The scanner 150 also includes a contact image sensor that reads a second surface of the document MS. The contact image sensor will be described later.

Figure 4:
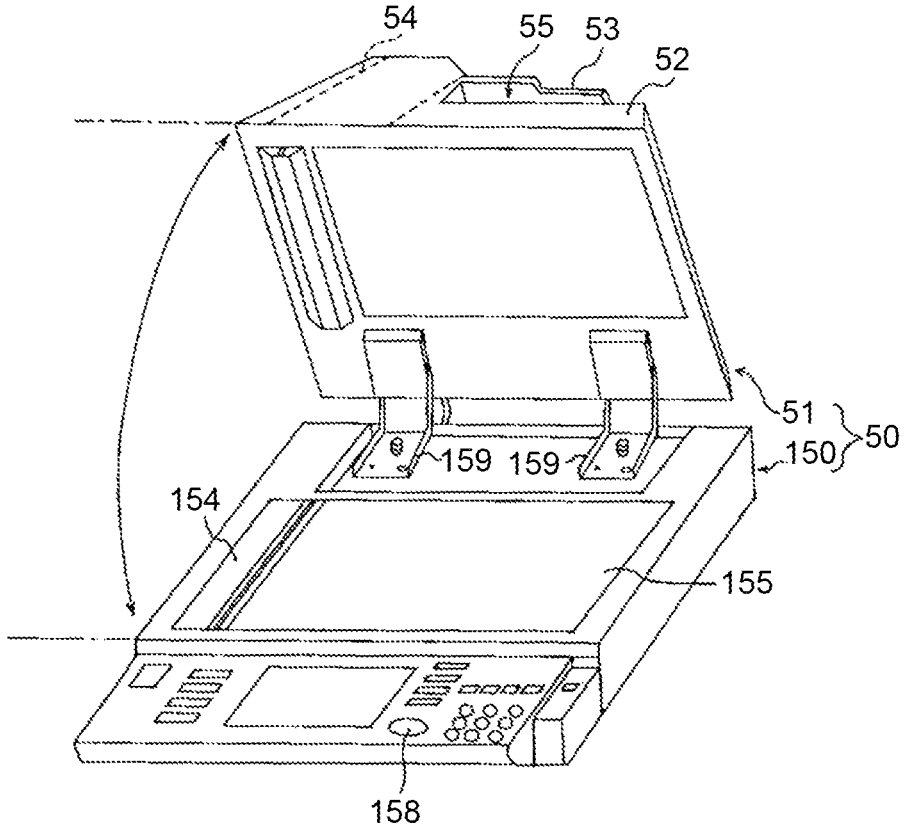
FIG. 4 is a perspective view illustrating a scanner and an automatic document feeder (ADF) of the copier.

The ADF 51 disposed on top of the scanner 150 retains, in a body cover 52 thereof, a document placing table 53 for placing thereon the document MS before scanning, a conveying unit 54 for conveying the document MS, a document stacking table 55 for stacking the document MS after scanning, and so on. As illustrated in FIG. 4, the ADF 51 is supported by hinges 159 fixed on the scanner 150 so as to be swingable in the up and down directions. The ADF 51 makes the swinging motion like an open/close door, and when it is opened, exposes a first contact glass 154 and a second contact glass 155 on the top surface of the scanner 150. When the document is a side-bound document, such as a book, formed by binding an edge of a document bundle, the document cannot be separated into single sheets, and therefore cannot be conveyed by the ADF 51. Therefore, when the document is a side-bound document, the ADF 51 is opened as illustrated in FIG. 4, and a page to be read of the side-bound document is opened and placed facing downward on the second contact glass 155. Thereafter, the ADF 51 is closed. Then, the movable scanning unit 152 of the scanner 150 illustrated in FIG. 1 reads an image on the page.

When, instead, the document is a document bundle obtained by simply stacking a plurality of separate documents MS, the ADF 51 can automatically convey each of the documents MS one by one, and the first-surface fixed scanning unit 151 in the scanner or the contact image sensor in the ADF 51 can sequentially read the documents MS. In this case, the document bundle is set on the document placing table 53, and then, a copy start button 158 is pressed. Then, the ADF 51 feeds the documents MS of the document bundle placed on the document placing table 53 sequentially from the top downward into the conveying unit 54, and conveys, while reversing, the documents toward the document stacking table 55. In this conveying process, the document MS immediately after being reversed is passed directly above the first-surface fixed scanning unit 151 of the scanner 150. At this time, the first-surface fixed scanning unit 151 of the scanner 150 reads an image on the first surface of the document MS.

Figure 5:
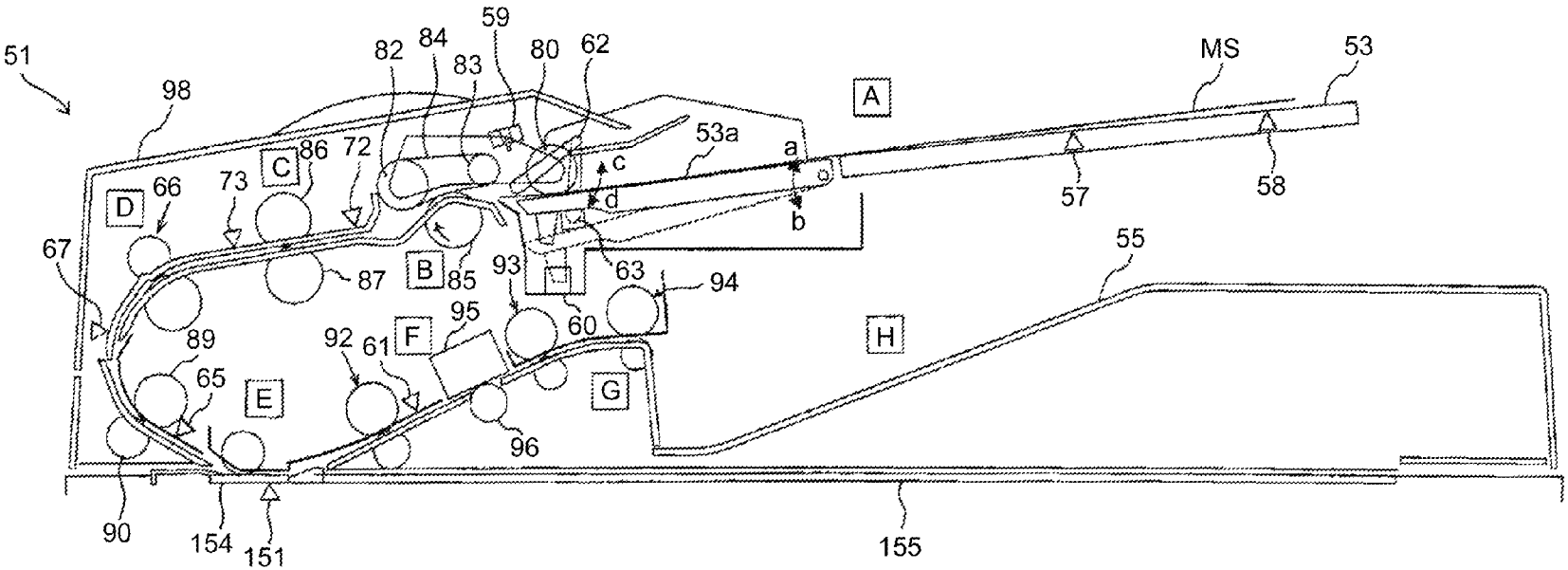
FIG. 5 is an enlarged configuration diagram illustrating a configuration of a relevant portion of the ADF together with an upper portion of the scanner.
Figure 6:
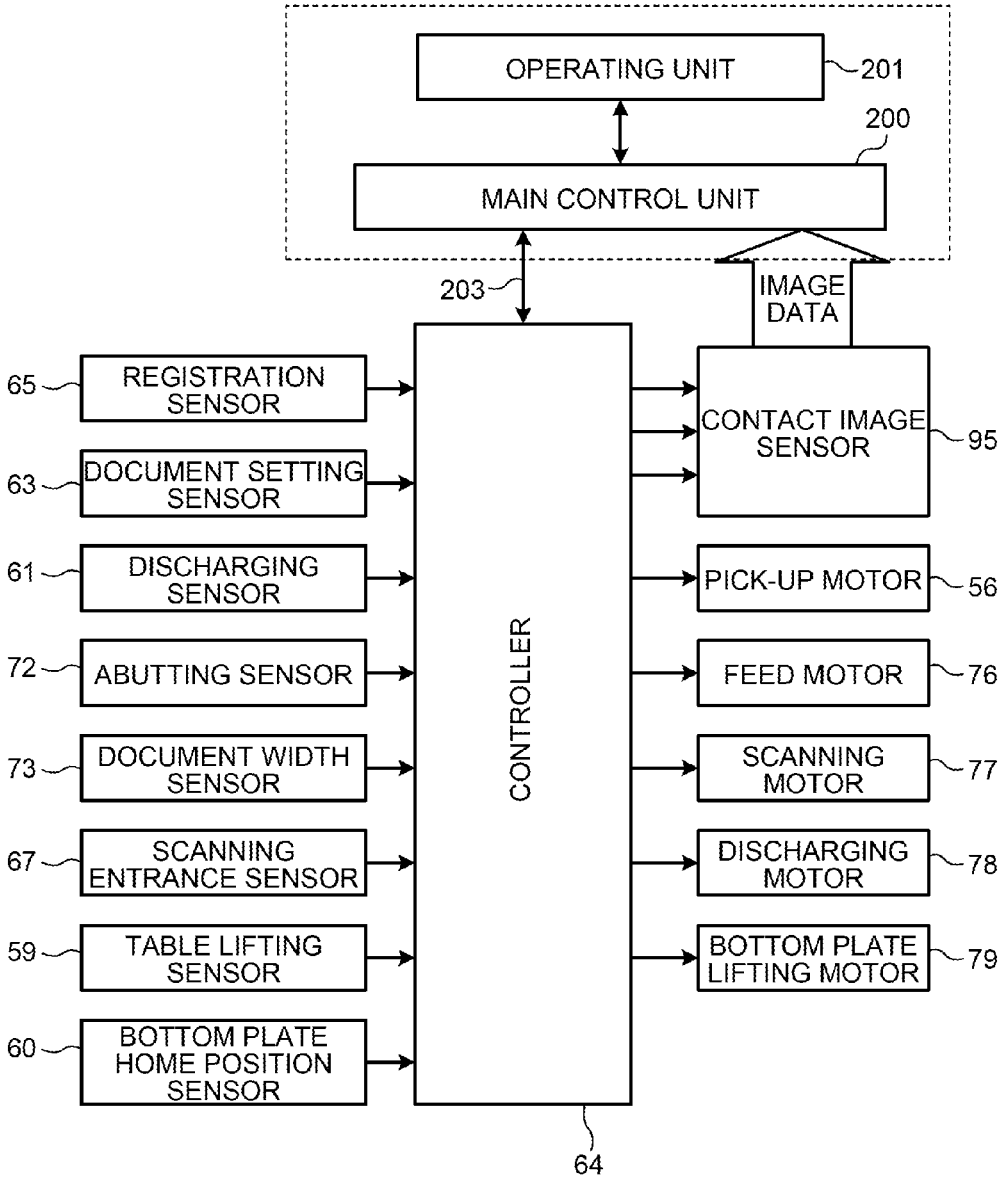
FIG. 6 is a block diagram illustrating a part of an electrical circuit of the copier.

FIG. 5 is an enlarged configuration diagram illustrating a configuration of a relevant portion of the ADF 51 together with an upper portion of the scanner 150. FIG. 6 is a block diagram illustrating a part of an electrical circuit for the ADF 51 and the scanner 150. The ADF 51 includes units such as a document setting unit A, a separating/feeding unit B, a registration unit C, a turning unit D, a first scan conveying unit E, a second scan conveying unit F, a discharging unit G, and a stacking unit H.

As illustrated in FIG. 6, the ADF 51 includes a controller 64 composed of an application specific integrated circuit (ASIC), and the like, and can use the controller 64 to control various devices and sensors. The controller 64 is connected to a registration sensor 65, a document setting sensor 63, a discharging sensor 61, an abutting sensor 72, a document width sensor 73, a scanning entrance sensor 67, a table lifting sensor 59, and a bottom plate home position sensor 60. The controller 64 is also connected to a contact image sensor 95, a pick-up motor 56, a feed motor 76, a scanning motor 77, a discharging motor 78, and a bottom plate lifting motor 79. The controller 64 is further connected to other elements including a main control unit 200 controlling devices of the scanner. The scanner 150 includes the main control unit 200 composed of a central processing unit (CPU), a random access memory (RAM), and the like (not illustrated), and can use the main control unit 200 to control various devices and sensors (not illustrated) in the scanner 150. The scanner 150 is connected to the controller 64 of the ADF 51 via an I/F 203, and can indirectly control the various devices and the sensors in the ADF 51 via the controller 64.

In FIG. 5, the document setting unit A includes components such as the document placing table 53 on which the bundle of the documents MS is set. The separating/feeding unit B separates and feeds the documents MS one by one from the bundle of the documents MS set on the table. The registration unit C temporarily abuts against the documents MS being fed to align them, and then feeds out the documents MS. The turning unit D includes a curved conveying portion curved in a C-shape in which the document MS turns to be reversed upside down. The first scan conveying unit E conveys the document MS on the first contact glass 154, and, at the same time, lets the first surface of the document MS be read by the first-surface fixed scanning unit 151 disposed inside the scanner (not illustrated) below the first contact glass 154. The second scan conveying unit F conveys the document MS under the contact image sensor 95, and, at the same time, lets the second surface of the document MS be read by the contact image sensor 95. The discharging unit G discharges, toward the stacking unit H, the document MS whose images on both surfaces have been read. The stacking unit H stacks the documents MS on the stacking table 55.

The front edge of the documents MS is placed on a movable document table 53*a* that is swingable in directions of arrows a and b in FIG. 5 corresponding to the thickness of the bundle of the documents MS, while the trailing end of the documents MS is placed on the document placing table 53, and thus, the documents MS are set. At this time, side guides (not illustrated) abut against both ends in the width direction (in the direction perpendicular to the plane of FIG. 5) of the documents MS on the document placing table 53, and thus, the position in the width direction of the documents MS is regulated. The documents MS set in this manner push up a lever member 62 disposed in a swingable manner above the movable document table 53*a*. This leads to detection of the setting of the documents MS by the document setting sensor 63, and then to sending of a detection signal to the controller 64. The detection signal is then sent from the controller 64 to the main control unit 200 via the I/F 203.

The document placing table 53 holds a first length sensor 57 and a second length sensor 58 each composed of a reflective photo sensor or a sensor of an actuator type that detects the length in the conveying direction of the documents MS. These length sensors detect the length in the conveying direction of the documents MS.

A pick-up roller 80 is arranged above the bundle of the documents MS placed on the movable document table 53*a* and supported so as to be movable in the up and down directions (in directions of arrows c and d in FIG. 5) by a cam mechanism. The cam mechanism is driven by the pick-up motor 56 so as to be capable of moving the pick-up roller 80 up and down. Moving up the pick-up roller 80 leads to a swing of the movable document table 53*a* in the direction of arrow a in FIG. 5, so that the pick-up roller 80 comes in contact with the uppermost document MS in the bundle of the documents MS. Moving further up the movable document table 53*a* eventually causes the table lifting detection sensor 59 to detect that the movable document table 53*a* is lifted to the upper limit. This detection stops the pick-up motor 56, leading to stop of the lifting of the movable document table 53*a*.

An operator performs operations on an operating unit 201 that is composed of a numeric keypad, a display, and the like, and that is provided on the body of the copier. The operations include a key operation by the operator for scanning mode setting of indicating whether the scanning mode is a duplex scanning mode or a single-side scanning mode, and a pressing operation of the copy start key. In other words, the operating unit 201 serves as a mode information acquiring unit that acquires information as to whether the scanning mode is the duplex scanning mode or the single-side scanning mode. Pressing of the copy start key causes the main control unit 200 to send a document feed signal to the controller 64 of the ADF 51 via the I/F 203. Accordingly, the pick-up roller 80 is rotationally driven by normal rotation of the feed motor 76, and feeds the document MS on the movable document table 53*a* out of the movable document table 53*a*.

The setting as to whether the scanning mode is the duplex scanning mode or the single-side scanning mode can be collectively applied to all of the documents MS placed on the movable document table 53*a*. It is also possible to individually set the scanning mode for each of the documents MS; that is, for example, the first and the tenth documents MS can be set to the duplex scanning mode, and the other documents MS can be set to the single-side scanning mode.

The document MS fed out by the pick-up roller 80 enters the separating/feeding unit B, and is fed into a contact position with a paper feeding belt 84. The paper feeding belt 84 is looped in a tensioned state between a driving roller 82 and a driven roller 83, and is endlessly moved in the clockwise direction in FIG. 5 by rotation of the driving roller 82 along with the normal rotation of the feed motor 76. A reverse roller 85 rotationally driven in the clockwise direction in FIG. 5 by the normal rotation of the feed motor 76 contacts the lower tense surface of the paper feeding belt 84. The surface of the paper feeding belt 84 moves in the paper feeding direction at the contact portion. The reverse roller 85 is in contact with the paper feeding belt 84 at a predetermined pressure, and, while the reverse roller 85 is directly in contact with the paper feeding belt 84, or while one sheet of the document MS is nipped at the contact portion, the reverse roller 85 co-rotate with the belt or the document MS. However, when a plurality of documents MS are nipped at the contact portion, the co-rotational force is reduced to a smaller value than a torque value of a torque limiter, so that the reverse roller 85 is rotationally driven in the clockwise direction in FIG. 5 opposite to the direction of co-rotation. As a result, the reverse roller 85 applies a moving force in the direction opposite to the paper feeding direction to documents MS under the uppermost document MS, so that only the uppermost document MS is separated from the other documents.

The document MS separated into one sheet by the operation of the paper feeding belt 84 and the reverse roller 85 enters the registration unit C. Then, the front edge of the document MS is detected when passing immediately below the abutting sensor 72. At this time, the pick-up roller 80 receiving the driving force of the pick-up motor 56 is still rotationally driven, but is separated from the document MS by downward movement of the movable document table 53*a*. As a result, the document MS is conveyed only by the endless moving force of the paper feeding belt 84. The paper feeding belt 84 continues the endless movement thereof for a predetermined time after the abutting sensor 72 has detected the front edge of the document MS, and then, the front edge of the document MS abuts against a contact portion between a pullout driving roller 86 and a pullout driven roller 87 rotationally driven while contacting the pullout driving roller 86. While the front edge of the document MS abuts on the contact portion between the rollers, the trailing end of the documents MS is fed toward the paper feeding direction so that the front edge of the document MS is positioned at the contact portion while the document MS is bent by a predetermined amount. This operation corrects a skew (inclination) of the document MS, which takes an attitude along the paper feeding direction.

The pullout driven roller 87 serves both to correct the skew of the document MS and to convey the document MS corrected for the skew to a pair of intermediate rollers 66 located on the downstream side in the document conveying direction, and are rotationally driven by reverse rotation of the feed motor 76. The reverse rotation of the feed motor 76 starts rotation of the pullout driven roller 87 and one of the intermediate rollers 66 contacting each other, and stops the endless movement of the paper feeding belt 84. The pick-up roller 80 also stops rotating at this time.

The document MS fed out from the pullout driven roller 87 passes immediately below the document width sensor 73. The document width sensor 73 includes a plurality of paper detection units each composed of a reflective photo sensor and the like. The paper detection units are arranged side by side in the document width direction (in the direction perpendicular to the plane of FIG. 5). The size in width direction of the document MS is detected based on which of the paper detection units detects the document MS. The length in the conveying direction of the document MS is detected based on the time from when the abutting sensor 72 starts detecting the front edge of the document MS until the abutting sensor 72 no longer detects the trailing end of the document MS.

The front edge of the document MS whose width size has been detected by the document width sensor 73 enters the turning unit D, and is nipped at a contact portion between the intermediate rollers 66. The speed of conveying of the document MS by the intermediate rollers 66 is set higher than the conveying speed of the document MS in the first scan conveying unit E to be described later. This speed setting intends to reduce the time until the document MS is fed into the first scan conveying unit E.

The front edge of the document MS conveyed in the turning unit D passes through a position facing the scanning entrance sensor 67. This causes the scanning entrance sensor 67 to detect the front edge of the document MS, and consequently causes the speed of conveying of the document by the intermediate rollers 66 to be reduced in the time until the front edge is conveyed to a position of a pair of scanning entrance rollers (a pair of 89 and 90) located on the downstream side in the document conveying direction. The scanning motor 77 starts rotational driving, leading to respective starts of rotational driving of one roller of the scanning entrance rollers 89 and 90, one roller of a pair of scanning exit rollers 92, and one roller of a pair of second scanning exit rollers 93.

In the turning unit D, while the document MS is conveyed in the curved conveying path between the two pairs of the intermediate rollers 66 and the scanning entrance rollers 89 and 90, the upper and lower surfaces are reversed and the conveying direction is turned back. Then, after passing through a nip between the scanning entrance rollers 89 and 90, the front edge of the document MS passes immediately below the registration sensor 65. When the registration sensor 65 detects the front edge of the document MS at this time, the document conveying speed is reduced over a predetermined conveying distance, and the conveyance of the document MS is temporarily halted before reaching the first scan conveying unit E. In addition, a registration stop signal is sent to the main control unit 200 via the I/F 203.

The main control unit 200 that has received the registration stop signal sends a reading start signal, and consequently, the controller 64 controls the scanning motor 77 to restart the rotation thereby to increase the conveying speed of the document MS up to a predetermined conveying speed until the front edge of the document MS arrives in the first scan conveying unit E. The position of the front edge of the document MS is calculated based on a pulse count of the scanning motor 77, and at the time when the front edge of the document MS reaches the document read position of the first-surface fixed scanning unit 151, the controller 64 sends, to the main control unit 200, a gate signal that indicates an effective image area in the sub-scanning direction of the first surface of the document MS. The gate signal continues to be sent, and the first-surface fixed scanning unit 151 reads the first surface of the document MS, until the trailing end of the document MS passes out of the document read position of the first-surface fixed scanning unit 151.

The front edge of the document MS having passed through the first scan conveying unit E passes between the scanning exit rollers 92 to be described later, and then is detected by the discharging sensor 61. When the scanning mode is set to the single-side scanning mode, the contact image sensor 95 to be described later need not read the second surface of the document MS. Therefore, the detection of the front edge of the document MS by the discharging sensor 61 causes the discharging motor 78 to start normal rotational driving, thereby rotationally driving an ejecting roller on the lower side in FIG. 5 of a pair of ejecting rollers 94 in the clockwise direction in FIG. 5. In addition, based on a pulse count of the discharging motor from when the discharging sensor 61 has detected the front edge of the document MS, the time is calculated at which the trailing end of the document MS will pass out of a nip of the ejecting rollers 94. Based on the result of this calculation, the driving speed of the discharging motor 78 is reduced at the time immediately before the trailing end of the document MS passes out of the nip of the ejecting rollers 94, and the document MS ejected at a speed not causing the document MS to fly out of the stacking table 55.

When the scanning mode is set to the duplex scanning mode, after the discharging sensor 61 detects the front edge of the document MS, the time is calculated at which the front edge of the document MS reaches the contact image sensor 95 based on the pulse count of the scanning motor 77. Then, at the calculated time, the controller 64 sends, to the main control unit 200, a gate signal that indicates an effective image area in the sub-scanning direction on the second surface of the document MS. The gate signal continues to be sent, and the contact image sensor 95 reads the second surface of the document MS, until the trailing end of the document MS passes out of the document read position of the contact image sensor 95.

In order to prevent a longitudinal read line from being formed due to adherence, onto the reading surface, of paste-like foreign matter attached on the document MS, a coating process is applied to the reading surface of the contact image sensor 95 (CIS) serving as a second-surface scanning unit. A second reading roller 96 is disposed in a position opposed to the contact image sensor 95 as a document supporting unit that supports the document MS from the non-reading surface (first surface). The second reading roller 96 prevents the document MS from floating in the document read position of the contact image sensor 95, and serves as a reference white portion for acquiring shading data in the contact image sensor 95. While this copier uses the second reading roller 96 as the document supporting unit that supports the document MS in the position opposed to the contact image sensor 95, a guide plate-like member can be used.

Figure 7:
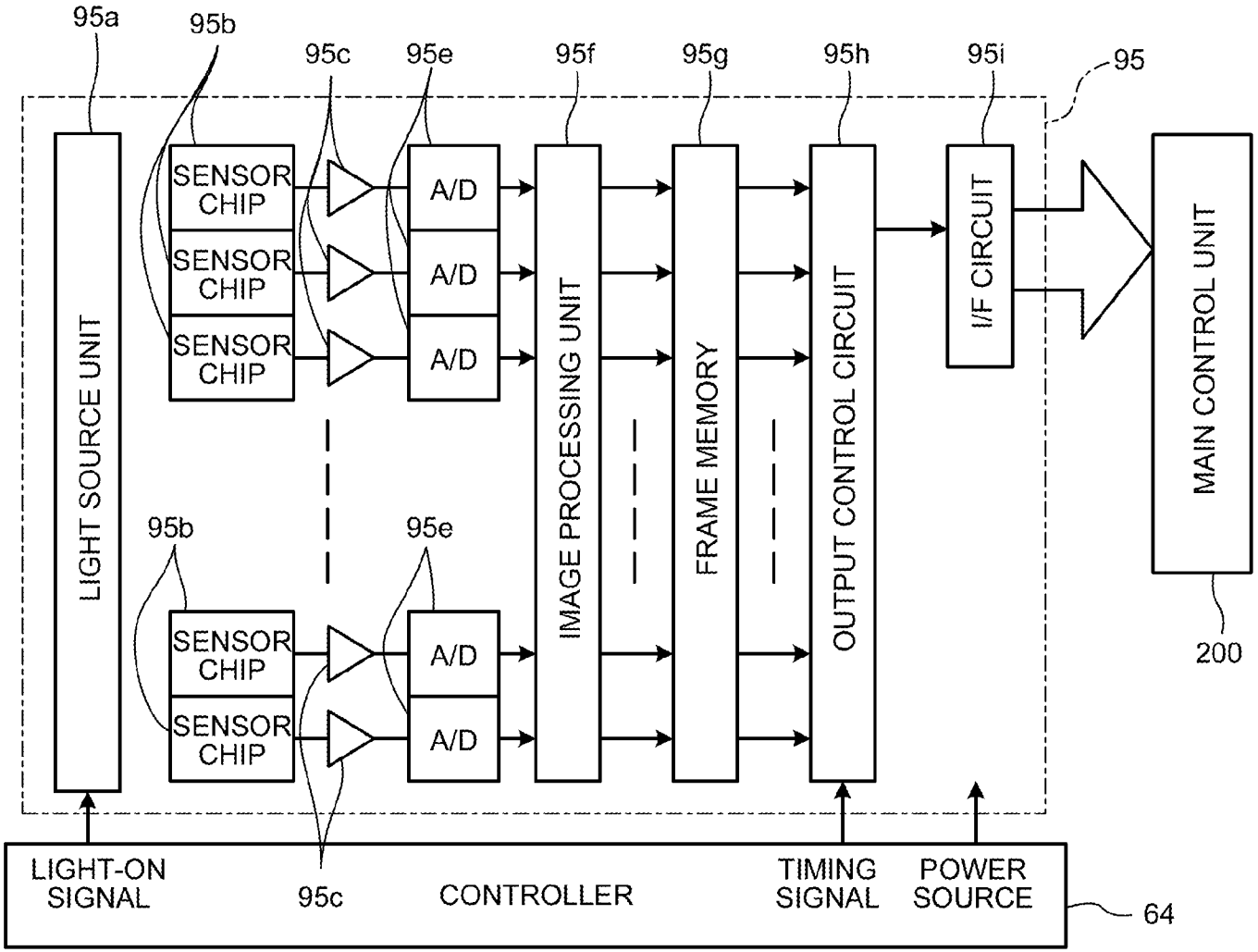
FIG. 7 is a block diagram illustrating a relevant portion of an electrical circuit of a contact image sensor.

FIG. 7 is a block diagram illustrating a relevant portion of an electrical circuit of the contact image sensor 95. As illustrated in FIG. 7, the contact image sensor 95 includes a light source unit 95*a* constituted by an LED array, a fluorescent lamp, a cold-cathode tube, or the like. The contact image sensor 95 also includes a plurality of sensor chips 95*b* that are arranged side by side in the main-scanning direction (in the direction corresponding to the document width direction), a plurality of OP amplifier circuits 95*c* that are individually connected to the respective sensor chips 95*b*, and a plurality of A/D converters 95*e* that are individually connected to the respective OP amplifier circuits 95*c*. The contact image sensor 95 further includes an image processing unit 95*f*, a frame memory 95*g*, an output control circuit 95*h*, an I/F circuit 95*i*, and the like.

The sensor chip 95*b* includes a photoelectric conversion element referred to as an equal-magnification contact image sensor and a collecting lens. Before the document (not illustrated) enters the document read position of the contact image sensor 95, the controller 64 sends a light-on signal to the light source unit 95*a*. This turns on the light source unit 95*a*, which, in turn, emits light toward the second surface of the document (not illustrated). In the sensor chips 95*b*, reflected light reflected on the second surface of the document is focused by the collecting lens onto the photoelectric conversion element, and is read as image information. The image information read by each of the sensor chips 95*b* is amplified by the OP amplifier circuit 95*c*, and then is converted into digital image information by the A/D converter 95*e*. The digital image information is supplied to the image processing unit 95*f* to be subjected to shading correction and the like, and then temporarily stored in the frame memory 95*g*. Thereafter, the digital image information is converted by the output control circuit 95*h* into a data format acceptable by the main control unit 200, and then is output to the main control unit 200 via the I/F circuit 95*i*. The controller 64 outputs a timing signal for informing the time when the front edge of the document reaches the document read position of the contact image sensor 95 (image data after this time is treated as effective data), the light-on signal for the light source, a power source, and the like.

Next, a description will be made of the separating/feeding unit B, which is a characteristic part of the present embodiment.

Figure 8:
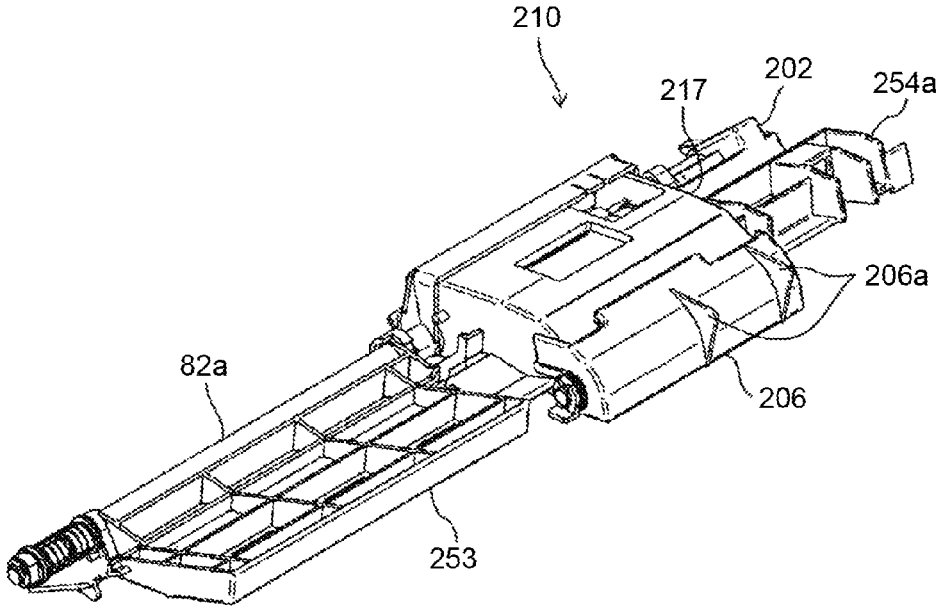
FIG. 8 is a perspective view, as viewed from above, of a feed mechanism constituting a part of a separating/feeding unit of the ADF.
Figure 9:
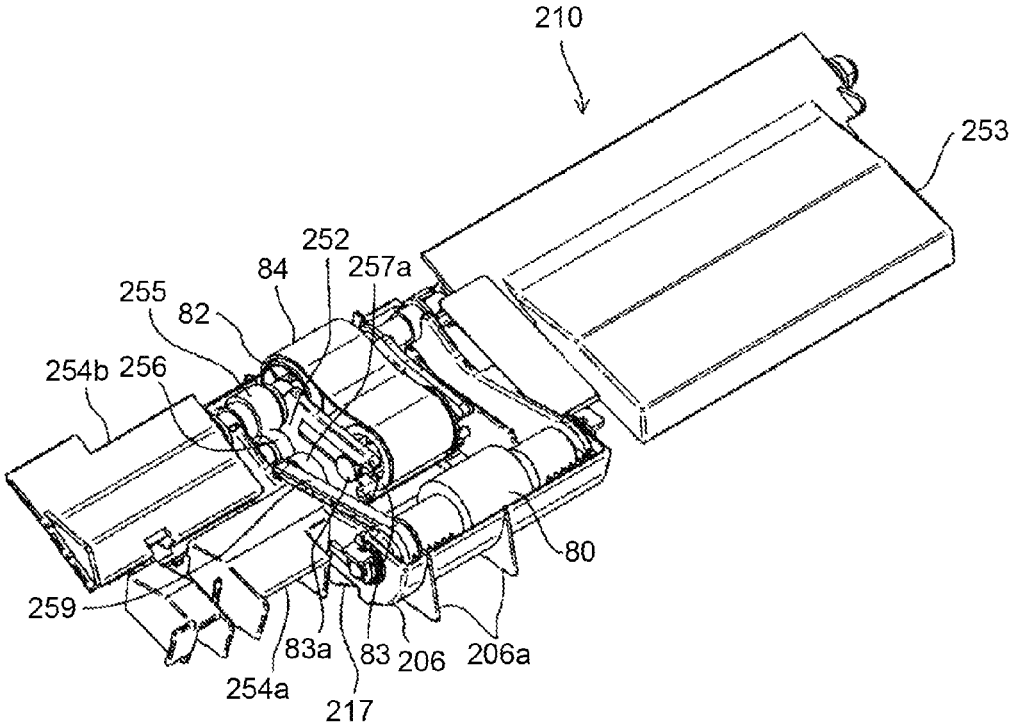
FIG. 9 is a perspective view, as viewed from below, of the feed mechanism.
Figure 10:
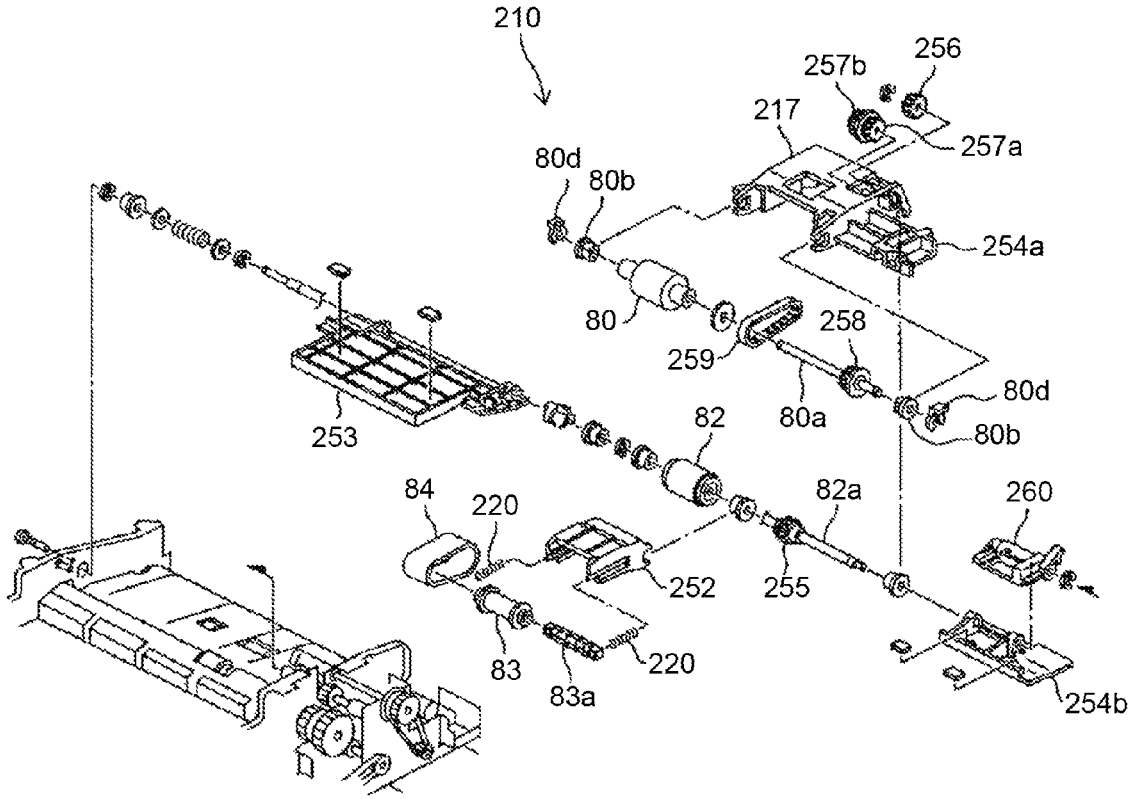
FIG. 10 is an exploded perspective view of the feed mechanism.

FIG. 8 is a perspective view, as viewed from above, of a feed mechanism 210 constituting a part of the separating/feeding unit B of the ADF 51. FIG. 9 is a perspective view, as viewed from below, of the feed mechanism 210. FIG. 10 is an exploded perspective view of the feed mechanism 210.

As illustrated in FIG. 9, the feed mechanism 210 serving as a sheet conveying device includes a holder 217 serving as a holding member that holds the pick-up roller 80 and the paper feeding belt 84. The holder 217 is rotatably supported on a driving shaft 82*a*. The driving roller 82 over which the paper feeding belt 84 is looped in a tensioned state is held by the driving shaft 82*a* through a one-way clutch (not illustrated).

A belt holder 252 is provided at both ends of the driving roller 82. Both side faces of the belt holder 252 have respective cutouts extending from the central parts of the side faces toward the direction departing from the driving roller 82. Springs (biasing members) 220 (refer to FIG. 10) are mounted at the respective cutouts.

The cutouts retain a shaft 83*a* of the driven roller 83 in a manner slidable in the cutouts. The springs 220 urge the driven roller 83 in the direction departing from the driving roller 82, and, by thus urging the driven roller 83, apply a tensile force to the paper feeding belt 84.

Both ends in the axial direction of the holder 217 are provided with guides that slidingly contact, in the document width direction, the document fed by the pick-up roller 80 so as to guide the document toward the registration unit C. The guide at one end in the axial direction (on the near side in FIG. 8 and on the far side in FIG. 9) of the holder 217 is constituted by a plate-like guide 253 that is rotatably mounted on the driving shaft 82*a*. The guide at the other end of the holder 217 is constituted by an upstream guide 254*a* and a downstream guide 254*b*. The upstream guide 254*a* located on the upstream side in the document conveying direction is provided on the holder 217, and the downstream guide 254*b* located on the downstream side in the document conveying direction is rotatably mounted on the driving shaft 82*a*. The document conveyed into the separating/feeding unit B is conveyed while both ends in the width direction of the document brush against the guides 253, 254*a*, and 254*b*, which also serve thereby to prevent the ends in the width direction of the document from floating.

The downstream guide plate 254*b* is provided thereon with a raising/lowering member 202 that raises and lowers the holder 217. The raising/lowering member 202 is rotatably assembled to the driving shaft 82*a* as illustrated in FIG. 10.

Figure 11:
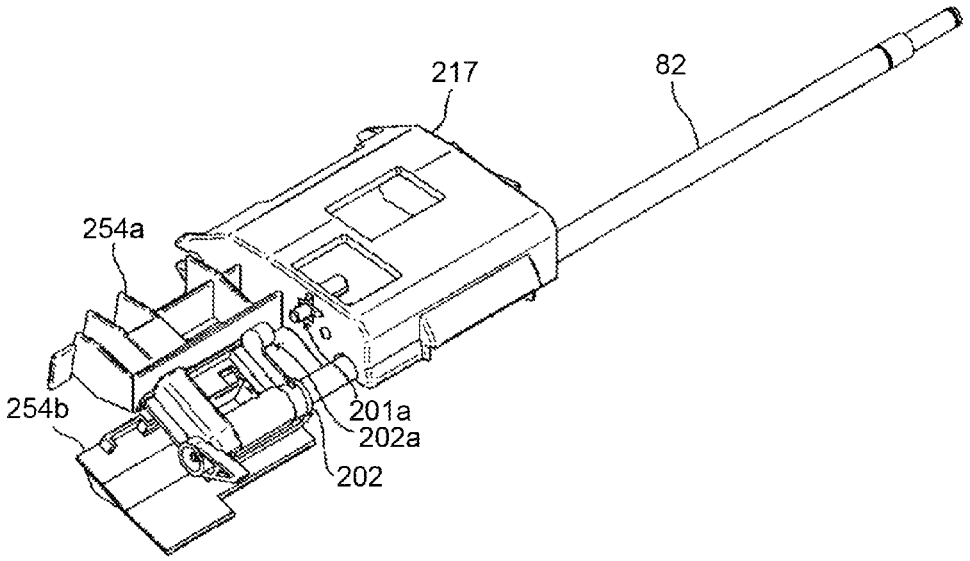
FIG. 11 is a perspective view illustrating a state of assembly of a raising/lowering member.

FIG. 11 is a perspective view illustrating a state of assembly of the raising/lowering member 202.

As illustrated in FIG. 11, the holder is provided, on a side face thereof, with a projection 201*a* having a projecting shape, and the raising/lowering member 202 is provided with a fitting hole 202*a* that fits with the projection 201*a*. The fitting hole 202*a* of the raising/lowering member 202 fits with the projection 201*a* of the holder 217, so that, when the cam mechanism (not illustrated) is rotationally driven by driving of the pick-up motor 56, the cam mechanism swings the raising/lowering member 202 about the driving shaft 82*a* serving as a fulcrum. This swing causes the holder 217 to swing, in conjunction with the raising/lowering member 202, about the driving shaft 82*a* serving as the fulcrum. This, in turn, moves the pick-up roller 80 held by the holder 217 in the up and down directions (in the c and d directions illustrated in FIG. 5 mentioned above).

As illustrated in FIGS. 9 and 10 mentioned above, a driving gear 255 is fixed to the driving shaft 82*a*. The driving gear 255 meshes with an idler gear 256 rotatably mounted on the holder 217, and the idler gear 256 meshes with a belt gear 257*a* rotatably mounted on the holder 217. A driving pulley 257*b* (refer to FIG. 10) is provided coaxially with the belt gear 257*a*, and a timing belt 259 is looped between the driving pulley 257*b* and a driven pulley 258 provided on a pick-up shaft 80*a*.

When a driving force is transmitted from the feed motor 76 via the driving shaft 82*a* to the driving gear 255, the driving force is further transmitted via the idler gear 256, the belt gear 257*a*, the timing belt 259, and the like, to the pick-up roller 80, which is thus rotationally driven.

The present embodiment uses a DC motor as the feed motor 76. Using a DC motor can promote energy saving compared with a case of using a stepping motor as the feed motor 76.

The pick-up roller 80 is fixed to the pick-up shaft 80*a*, which is rotatably held by the holder 217 through shaft bearings 80*b*. Grooves 181 (refer to FIG. 15) are provided at outsides of positions where the shaft bearings 80*b* of the pick-up shaft 80*a* are fitted, and retaining members 80*d* illustrated in FIG. 10 are mounted in the grooves 181. A pick-up cover 206 is rotatably mounted on the shaft bearings 80*b*, and covers the pick-up roller 80. The pick-up cover 206 is provided with ribs 206*a* at two places with a predetermined distance in the axial direction therebetween.

Figure 12:
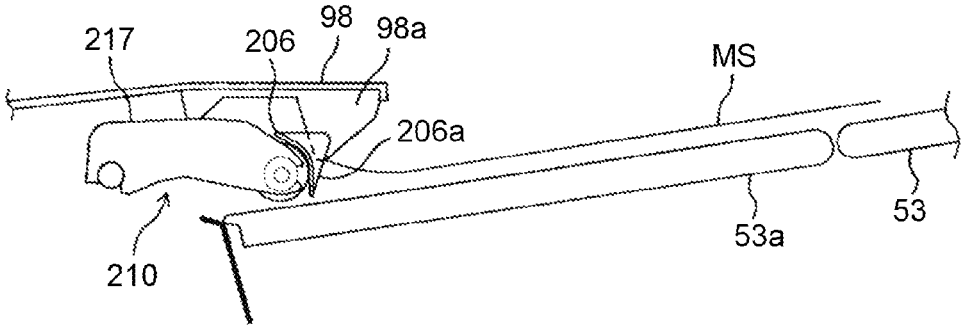
FIG. 12 is an enlarged configuration diagram of a neighborhood of the separating feed unit.

FIG. 12 is an enlarged configuration diagram of a neighborhood of the separating/feeding unit B.

As illustrated in FIG. 12, a plurality of ribs 98*a* are also provided at an end on the document placing table side of a paper feeding cover 98. The ribs 98*a* are provided between the ribs 206*a* of the pick-up cover 206. Also, as illustrated in FIG. 12, the ribs 206*a* of the pick-up cover 206 partially overlap the ribs 98*a* of the paper feeding cover 98 when viewed from the axial direction of the ADF 51. This overlap can prevent the front edge of the document from entering a clearance between the pick-up cover 206 and the paper feeding cover 98.

Figure 13:
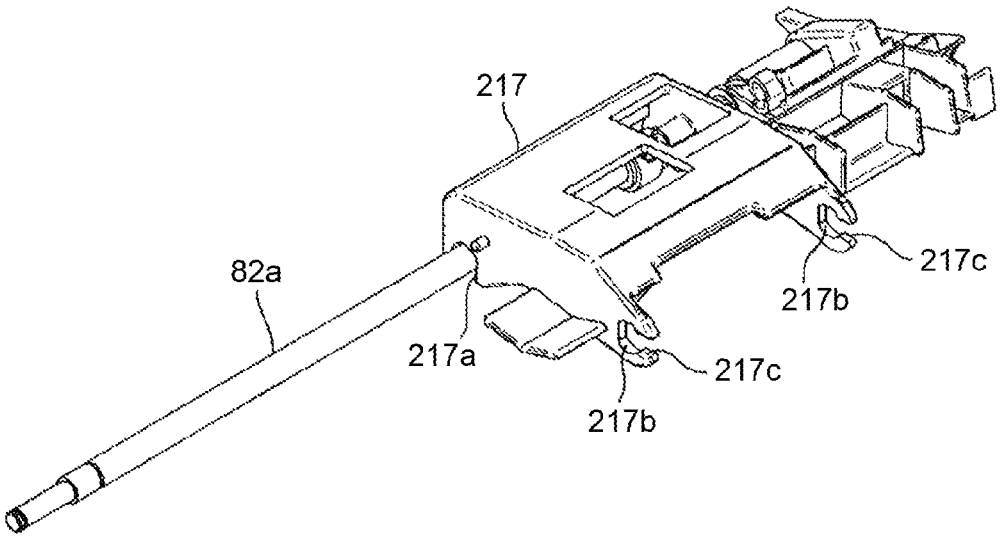
FIG. 13 is a perspective view illustrating a holder.
Figure 14:
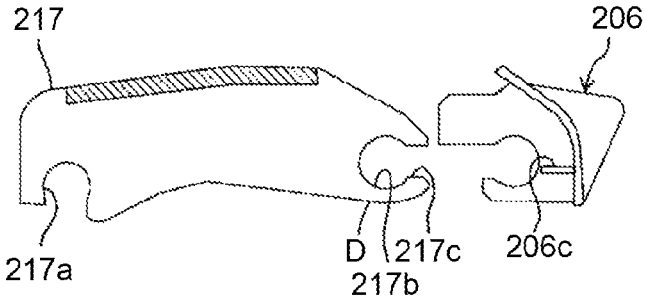
FIG. 14 is a cross-sectional view illustrating the holder and a pick-up cover.

FIG. 13 is a perspective view illustrating the holder 217, and FIG. 14 is a cross-sectional view illustrating the holder 217 and the pick-up cover 206.

As illustrated in FIGS. 13 and 14, the holder 217 includes driving shaft mounting portions 217*a* for being rotatably mounted on the driving shaft 82*a* and pick-up mounting portions 217*b* on which the pick-up roller 80 is rotatably mounted with the shaft bearings 80*b* interposed therebetween. In addition, pick-up shaft insertion cutouts 217*c* are provided extending parallel to the document conveying direction (toward the document placing table 53) from the pick-up mounting portions 217*b*. The driving shaft mounting portions 217*a* have a cutout shape extending toward the document conveying path. Note that the reference numeral 206*c* in FIG. 14 represents rotation restricting portions that restrict rotation of the pick-up cover 206. The rotation restricting portions 206*c* will be described in detail later.

Figure 15:
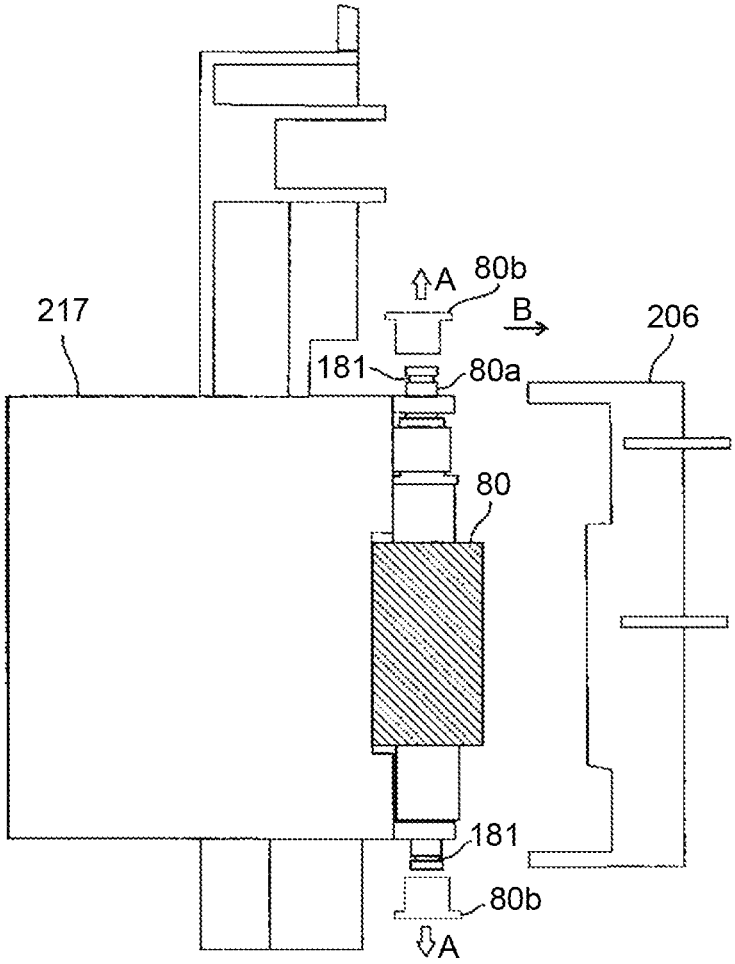
FIG. 15 is a view illustrating a state of removal of a pick-up roller.

FIG. 15 is a view illustrating a state of removal of the pick-up roller 80.

The pick-up roller 80 is removed from the holder 217 as follows. First, the retaining members 80*d* (refer to FIG. 10) are removed from the pick-up shaft 80*a*. Thereafter, the shaft bearings 80*b* are moved in directions of arrows A (in axial directions) in FIG. 15, and removed from the pick-up mounting portions 217*b*. Then, the pick-up cover 206 is moved in the direction of arrow B in FIG. 15 to expose the pick-up roller 80, which is then moved in the direction of arrow B in FIG. 15, so that the pick-up roller 80 can be removed from the holder 217.

In the present embodiment, the pick-up shaft insertion cutouts 217*c* for mounting the pick-up roller 80 on the pick-up mounting portions 217*b* of the holder 217 extend in the conveying direction. The reason for this configuration is as follows. That is, if the pick-up mounting portions 217*b* have a cutout shape extending toward the document conveying path in the same manner as the driving shaft mounting portions 217*a*, the front edge of the document can be caught at the pick-up mounting portions 217*b* when the front edge of the document is curled or in a similar state. In contrast, as in the present embodiment, by extending the pick-up shaft insertion cutouts 217*c* for mounting the pick-up roller 80 on the pick-up mounting portions 217*b* of the holder 217 in the conveying direction, the document with a curl or the like at the front edge can be conveyed without being caught. In addition, as illustrated in FIG. 14, bottom portions D of the pick-up mounting portions 217*b* of the holder 217 can guide the document so as to convey the document smoothly.

Figure 16:
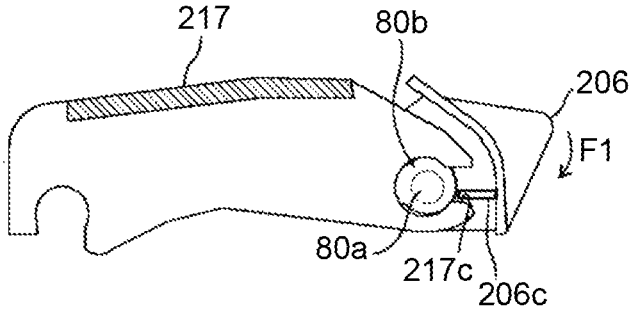
FIG. 16 is a cross-sectional view of a state in which the pick-up cover is mounted on a shaft bearing.

FIG. 16 is a cross-sectional view of a state in which the pick-up cover 206 is mounted on the shaft bearing 80*b*.

As illustrated in FIG. 16, when the pick-up cover 206 is mounted on the shaft bearing 80*b*, the tip of the rotation restricting portion 206*c* is positioned at the pick-up shaft insertion cutout 217*c*. The tip of the rotation restricting portion 206*c* contacts the pick-up shaft insertion cutout 217*c* so as to prevent the pick-up cover 206 from rotating in the direction of arrow F1 in FIG. 16. This forms a predetermined gap t between the pick-up cover 206 and the document (refer to FIG. 17), and thus can prevent the document from brushing against the pick-up cover 206.

Figure 17:
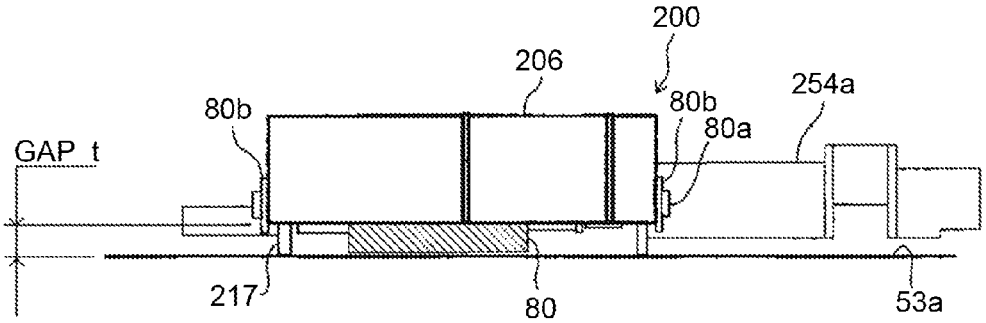
FIG. 17 is a schematic configuration diagram of the feed mechanism viewed from a document placing table.

FIG. 17 is a schematic configuration diagram of the feed mechanism 210 viewed from the document placing table 53.

As illustrated in FIG. 17, the predetermined gap t is provided between the pick-up cover 206 covering the pick-up roller 80 and the movable document table 53*a*.

A user may temporarily place an object, such as a necklace, other than the document (hereinafter called a foreign object) on top of the document bundle placed on the document placing table 53. If the user starts the document conveyance without remembering having placed the foreign object on top of the document bundle as described above, the foreign object on top of the document bundle is conveyed into the apparatus together with the uppermost sheet of the documents. As described above, the guides 253 and 254*a* contact the document near the both ends in the width direction of the document. Therefore, the foreign object, when it is near the width end of the document, is blocked by the guide plate, and thus is not conveyed into the ADF 51. However, if the foreign object is placed at the central part in the width direction of the document, a large value of the gap t between the pick-up cover 206 and the movable document table 53*a* may cause a kind of the foreign object, such as a necklace, having a relatively small height to slip through the gap between the pick-up cover 206 and the movable document table 53*a* to be conveyed into the separating/feeding unit B. The present embodiment uses, as described above, a DC motor as the feed motor 76 from the viewpoint of energy saving of the apparatus. Unlike a stepping motor, the DC motor does not stop due to stepping out of synchronism when a rotational load of the motor increases, and consequently continues rotational driving when the foreign object is wedged between the pick-up roller 80 and the movable document table 53*a* to increase a rotational load of the pick-up roller 80. As a result, the foreign object can be conveyed into the apparatus, and can cause the apparatus, for example, to break. Therefore, the gap t between the pick-up cover 206 and the movable document table 53*a* needs to be set as small as possible.

When the pick-up cover 206 covering the pick-up roller 80 is configured to be supported as a cantilever as described in Japanese Patent Application Laid-open No. H10-109773, the own weight or a mounting error of the pick-up cover 206 can cause the free end of the pick-up cover 206 to come in contact (gap t=0) with the movable document table 53*a*. In this case, the free end of the pick-up cover 206 brushes against the document, which causes the resistance of conveyance in the width direction to vary during the document conveyance. This can result in occurrence of the document skew or the like.

Figure 18:
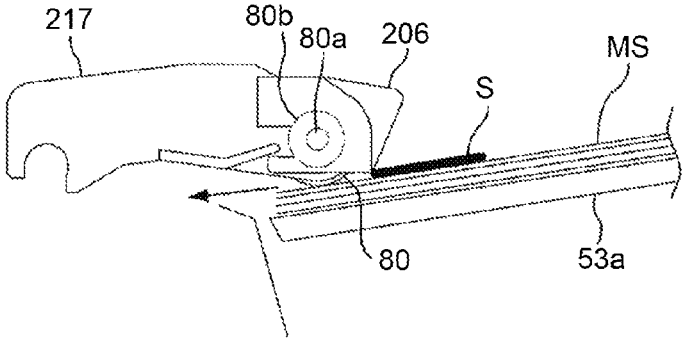
FIG. 18 is a diagram explaining blocking of a foreign object by the pick-up cover.

In the feed mechanism 210 of the present embodiment, as illustrated in FIG. 17, the pick-up cover 206 is supported at both ends by the pick-up shaft 80*a* through the shaft bearings 80*b*. This configuration can set the gap t more accurately than in the case of supporting the pick-up cover 206 as a cantilever. As a result, as illustrated in FIG. 18, the pick-up cover 206 can block a foreign object S placed on top of the document bundle MS, and thus can keep the foreign object S from being conveyed into the ADF 51. This can keep the foreign object S from causing parts in the ADF, for example, to break.

In the present embodiment, the pick-up cover 206 is mounted on the shaft bearings 80*b* receiving the pick-up shaft 80*a*, and thus can accurately provide the gap between the uppermost document and the pick-up cover 206 when the pick-up roller 80 contacts the uppermost document. Specifically describing, mounting the pick-up cover 206 on the holder 217 stacks component tolerances of the pick-up roller 80, the pick-up shaft 80*a*, the shaft bearings 80*b*, and the holder 217 to form a stack-up component tolerance. Mounting the pick-up cover 206 on the shaft bearings 80*b* eliminates the component tolerance of the holder 217. The component tolerance is smaller in the shaft bearings 80*b* and the pick-up shaft 80*a* that are composed of metal than in the holder 217 composed of resin. Consequently, the gap between the uppermost document and the pick-up cover 206 can be provided more accurately than in the case of mounting the pick-up cover 206 on the holder 217. As a result, even a small setting of the gap t can keep the pick-up cover 206 from contacting the document due to manufacturing errors or the like.

In the present embodiment, as illustrated in FIG. 17, the pick-up cover 206 has an axial length larger than that of the pick-up roller 80, and thus covers the whole of the pick-up roller 80 in the axial direction thereof. This configuration can satisfactorily keep the foreign object from being conveyed to the pick-up roller 80.

Figure 19:
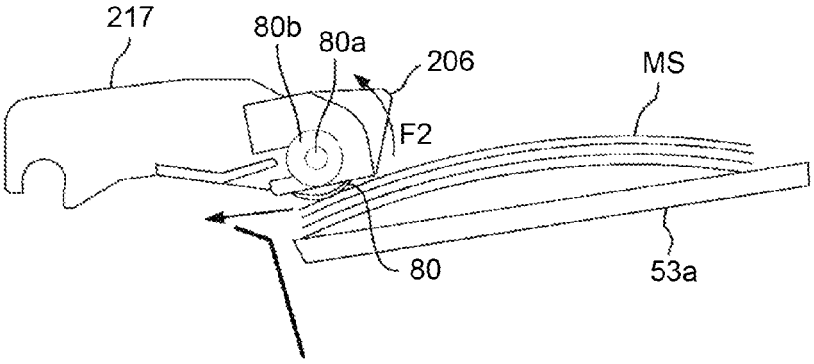
FIG. 19 is a diagram explaining feeding of a document when the document bundle is curled.
Figure 20:
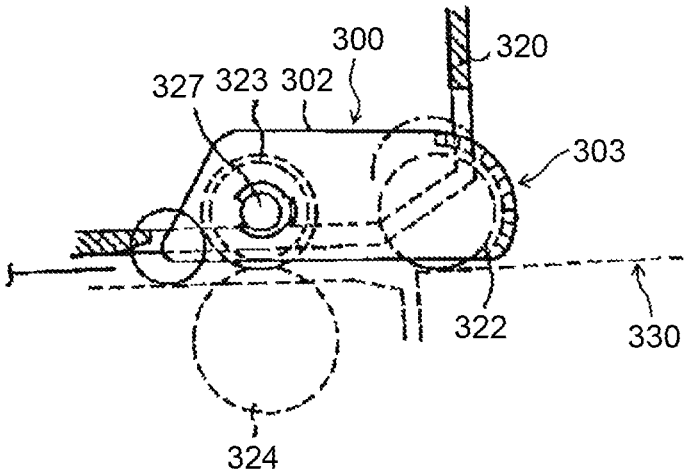
FIG. 20 is a schematic configuration diagram of a conventional sheet conveying device.
Figure 21:
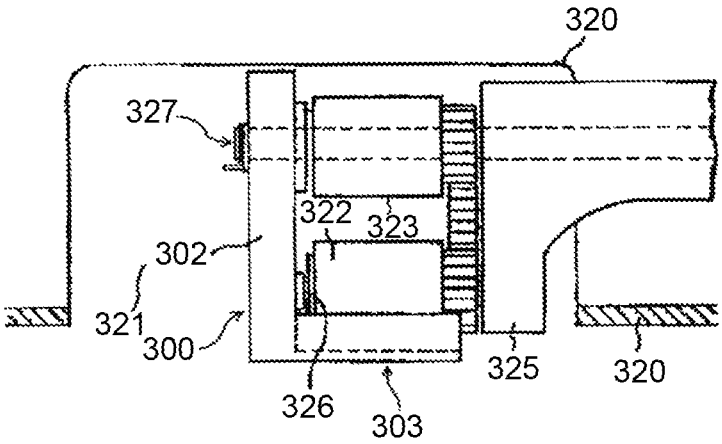
FIG. 21 is a plan view of the conventional sheet conveying device.

In the present embodiment, as described above, the pick-up cover 206 is rotatably mounted on the shaft bearings 80*b*. In the case in which the pick-up cover 206 is fixed to the holder 217, suppose, as illustrated in FIG. 19, that a document bundle that is curled so as to float at the central part thereof from the document placing table 53 is set on the document placing table. In that case, when the pick-up roller 80 is lowered for document conveyance by rotating the holder 217 about the driving shaft 82*a*, the tip of the pick-up cover comes into contact earlier than the pick-up roller 80. As described above, the present embodiment is configured to set the gap between the document and the pick-up cover 206 as small as possible so as to prevent the foreign object from being conveyed. As a result, when the pick-up roller 80 comes in contact with the uppermost document, the tip of the pick-up cover 206 can contact the document strongly. This can increase the frictional resistance of the document against the pick-up cover 206, and thus can cause a conveyance trouble or a damage of the document.

In contrast, as in the present embodiment, by configuring the pick-up cover 206 to rotate relative to the holder 217 in a predetermined range, the conveyance trouble and the damage of the document can be suppressed when the curled document bundle is set as illustrated in FIG. 19. Specifically, in the present embodiment, when the curled document bundle is set as illustrated in FIG. 19, the pick-up cover 206 rotates in the direction of arrow F2 in FIG. 19 about the shaft bearings 80*b* serving as fulcrums when the tip of the pick-up cover 206 comes into contact earlier than the pick-up roller 80 in the same manner as described above. Consequently, when the pick-up roller 80 comes in contact with the uppermost document of the document bundle, the contact pressure between the document and the pick-up cover 206 can be smaller than that in the configuration in which the pick-up cover 206 is fixed to the holder 217. As a result, the conveyance trouble and the damage of the document can be suppressed when the curled document bundle is set as illustrated in FIG. 19.

After the document conveyance as illustrated in FIG. 19, the pick-up cover 206 is rotated by the own weight thereof in the direction opposite to the direction of arrow F2 in FIG. 19, and the rotation restricting portions 206*c* abut against the pick-up shaft insertion cutouts 217*c* to form the predetermined gap t illustrated in FIG. 17 mentioned above. To suppress noise occurring when the rotation restricting portions 206*c* abut against the pick-up shaft insertion cutouts 217*c*, shock-absorbing members of sponge or the like may be provided on the rotation restricting portions 206*c*.

While the embodiment has been described above in which the present invention is applied to the ADF 51, the present invention can also be applied, for example, to a conveying mechanism that conveys a sheet bundle placed on a bypass tray into an apparatus.

The description given above is an example. The present invention brings about effects specific to each of the following aspects (1) to (7).

(1) In a sheet conveying device such as the feed mechanism 210 including the pick-up roller 80, which feeds, into the apparatus, a sheet on a placing table such as the document placing table 53 on which the sheet such as the document is placed, and a cover member such as the pick-up cover 206, which covers the pick-up roller 80, the cover member is supported at both ends thereof on the shaft 80*a* of the pick-up roller 80 or on the shaft bearings 80*b*, which receive the shaft of the pick-up roller 80.

With such a configuration, as described in the embodiment, a gap between the placing table and the cover member can be set small, so that a foreign object can be satisfactorily blocked by the cover member. As a result, it is possible to keep parts in the apparatus from being broken by the foreign object conveyed into the apparatus.

(2) In the sheet conveying device, such as the feed mechanism 210, of the aspect described above in (1), a DC motor is used as a driving source such as the feed motor 76, which rotationally drives the pick-up roller 80.

Such a configuration makes, as described in the embodiment, it possible to achieve energy saving compared with a case of using a stepping motor as the driving source. Although the DC motor used in this case does not stop driving, unlike the stepping motor, when a driving load is generated, the foreign object can be kept from being conveyed into the apparatus because the configuration of the aspect described above in (1) is employed.

(3) In the sheet conveying device, such as the feed mechanism 210, of the aspect described above in (1) or (2), the cover member such as the pick-up cover 206 is rotatably supported on the shaft 80*a* of the pick-up roller 80 or on the shaft bearings 80*b* that receive the shaft 80*a* of the pick-up roller 80.

Such a configuration makes, as described in the embodiment, it possible to keep the cover member from strongly contacting the sheet in the case in which the curled sheet bundle is set in the placing table illustrated in FIG. 19 mentioned above. As a result, the curled sheet bundle can be conveyed satisfactorily.

(4) The sheet conveying device, such as the feed mechanism 210, of the aspect described above in any one of (1) to (3) also includes a holding member such as the holder 217 that holds the pick-up roller 80. The holding member and the cover member such as the pick-up cover 206 are configured to be separate parts.

Such a configuration makes it possible to remove the cover member such as the pick-up cover 206 from the holding member such as the holder 217. Consequently, as described using FIG. 15 mentioned above, the pick-up roller 80 can be moved in the direction parallel to the document conveying direction to be removed from the holding member. As a result, as described in the embodiment, the document can be conveyed satisfactorily without being caught at the front edge thereof by the cutouts of the holding member for mounting the pick-up roller 80.

(5) In the sheet conveying device, such as the feed mechanism 210, of the aspect described above in any one of (1) to (4), the cover member such as the pick-up cover 206 has an axial length larger than that of the pick-up roller 80.

Such a configuration makes, as described in the embodiment, it possible to keep the foreign object from entering any place in the entire area in the axial direction of the pick-up roller 80.

(6) In an image reading device such as the document feeding/reading unit 50 including a document placement unit such as the document placing table 53 and a conveying unit that conveys a document on the document placement unit through a document read position of a document reading unit such as the scanner 150 toward a destination of conveyance, the sheet conveying device of the aspect described above in any one of (1) to (5) is used as the conveying unit.

Such a configuration makes it possible to keep the foreign object from entering the ADF 51, and thus to keep parts in the ADF from being broken.

(7) In an image forming apparatus such as a copier 500 including an image forming unit such as the image forming unit 1 that forms an image on a recording material such as the transfer sheet and an image reading unit such as the document feeding/reading unit 50 that reads an image on a document while conveying the document, and forming the image read by the image reading unit on the recording material by using the image forming unit forming, the image reading device of the aspect described above in (6) is used as the image reading unit.

Such a configuration makes it is possible to keep the image reading device from being broken.

According to the present invention, a cover member covering a pick-up roller is supported at both ends thereof. Therefore, unlike a configuration in which the cover member is supported as a cantilever, no such trouble occurs that the own weight or a mounting error of the cover member causes one end of the cover member to come in contact with a placing table. This configuration allows a clearance between the placing table and the cover member to be set smaller than that in the configuration in which the cover member is supported as a cantilever. As a result, when sheet conveyance is started while a foreign object having a small height is placed on top of a sheet bundle placed on the placing table, the cover member can block the foreign object, and thus can keep the foreign object from being conveyed into an apparatus. This result can keep parts, such as the pick-up roller, in the apparatus from being broken by the foreign object.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a pick-up roller that feeds, into an apparatus, a sheet on a placing table on which the sheet is placed; and a cover member that covers the pick-up roller; wherein the cover member is supported at both ends thereof and co-axially arranged on a shaft of the pick-up roller or on shaft bearings that receive the shaft of the pick-up roller such that the cover member pivots about the shaft of the pick-up roller.

2. The sheet conveying device according to claim 1, wherein a DC motor is used as a driving source that rotationally drives the pick-up roller.

3. The sheet conveying device according to claim 1, wherein the cover member is rotatably supported on the shaft of the pick-up roller or on the shaft bearings that receive the shaft of the pick-up roller.

4. The sheet conveying device according to claim 1, further comprising:

a holding member that holds the pick-up roller, wherein the holding member and the cover member are separate parts.

5. The sheet conveying device according to claim 1, wherein the cover member has an axial length larger than that of the pick-up roller.

6. An image reading device comprising:

a document placement unit; and a conveying unit that conveys a document on the document placement unit through a document read position of a document reading unit toward a destination of conveyance, wherein the conveying unit includes:

a pick-up roller that feeds, into an apparatus, a sheet on a placing table on which the sheet is placed; and a cover member that covers the pick-up roller, wherein the cover member is supported at both ends thereof and co-axially arranged on a shaft of the pick-up roller or on shaft bearings that receive the shaft of the pick-up roller such that the cover member pivots about the shaft of the pick-up roller.

7. An image forming apparatus comprising:

an image reading unit that reads an image on a document while conveying the document, an image forming unit that forms the image read by the image reading unit on a recording material; wherein the image reading unit includes:

a document placement unit; and a conveying unit that conveys a document on the document placement unit through a document read position of a document reading unit toward a destination of conveyance, wherein the conveying unit includes:

a pick-up roller that feeds, into an apparatus, a sheet on a placing table on which the sheet is placed; and a cover member that covers the pick-up roller, wherein the cover member is supported at both ends thereof and co-axially arranged on a shaft of the pick-up roller or on shaft bearings that receive the shaft of the pick-up roller such that the cover member pivots about the shaft of the pick-up roller.

8. The sheet conveying device according to claim 1, wherein a tip of the cover member comes into contact earlier than the pick-up roller when the pick-up roller is lowered for sheet conveyance.

9. The sheet conveying device according to claim 8, wherein the pick-up roller is lowered for sheet conveyance by rotating a holder about a driving shaft.

10. The sheet conveying device according to claim 1, wherein the cover member is provide with ribs.

11. The sheet conveying device according to claim 10, wherein the ribs are at two places on the cover member at a set distance in an axial direction therebetween.

12. The sheet conveying device according to claim 10, further comprising a paper feeding cover, wherein the paper feeding cover includes a plurality of ribs provided at an end on the placing table side of the paper feeding cover.

13. The sheet conveying device according to claim 12, wherein the plurality of ribs of the paper feeding cover are provided between the ribs of the cover member to prevent a front edge of the sheet from entering a clearance between the cover member and the paper feeding cover.

14. The sheet conveying device according to claim 13, wherein the ribs of the cover member partially overlap with the ribs of the paper feeding cover.

15. The sheet conveying device according to claim 4, wherein the holding member includes driving shaft mounting portions for being rotatably mounted on a driving shaft and pick-up mounting portions on which the pick-up roller is rotatably mounted with the shaft bearings interposed therebetween.

16. The sheet conveying device according to claim 15, further comprising pick-up shaft insertion cutouts, wherein the pick-up shaft insertion cutouts extends parallel to the document conveying direction from the pick-up mounting portions.

17. The sheet conveying device according to claim 16, wherein when the cover member is mounted on the shaft bearings, a tip of a rotation restricting portion is positioned at the pick-up shaft intersection cutouts.

18. The sheet conveying device according to claim 17, wherein the tip of the rotation restricting portion contacts the pick-up shaft insertion cutouts so as to prevent the cover member from rotating in a set direction.

19. The sheet conveying device according to claim 1, further comprising grooves on the shaft of the pick-up roller at outside positions where the shaft bearings are fitted.

20. The sheet conveying'device according to claim 19, further comprising retaining members, the retaining members being mounted in the grooves.

21. A sheet conveying device comprising:

a pick-up roller that feeds, into an apparatus, a sheet on a placing table on which the sheet is placed; and a cover member that covers the pick-up roller, wherein:

the cover member is supported at both ends thereof and co-axially arranged on a shaft of the pick-up roller or on shaft bearings that receive the shaft of the pick-up roller, and a tip of the cover member comes into contact earlier than the pick-up roller when the pick-up roller is lowered for sheet conveyance.

22. A sheet conveying device comprising:

a pick-up roller that feeds, into an apparatus, a sheet on a placing table on which the sheet is placed;

a cover member that covers the pick-up roller, the cover member being supported at both ends thereof and co-axially arranged on a shaft of the pick-up roller or on shaft bearings that receive the shaft of the pick-up roller;

a holding member that holds the pick-up roller, wherein:

the holding member and the cover member are separate parts, and the holding member includes driving shaft mounting portions for being rotatably mounted on a driving shaft and pick-up mounting portions on which the pick-up roller is rotatably mounted with the shaft bearings interposed therebetween; and pick-up shaft insertion cutouts, the pick-up shaft insertion cutouts extends parallel to the document conveying direction from the pick-up mounting portions, wherein when the cover member is mounted on the shaft bearings, a tip of a rotation restricting portion is positioned at the pick-up shaft intersection cutouts.

23. A sheet conveying device comprising:

a pick-up roller that feeds, into an apparatus, a sheet on a placing table on which the sheet is placed;

a cover member that covers the pick-up roller, wherein:

the cover member is supported at both ends thereof and co-axially arranged on a shaft of the pick-up roller or on shaft bearings that receive the shaft of the pick-up roller; and grooves on the shaft of the pick-up roller at outside positions where the shaft bearings are fitted.

24. A sheet conveying device comprising:

a pick-up roller that feeds, into an apparatus, a sheet on a placing table on which the sheet is placed;

a cover member that covers the pick-up roller, wherein:

the cover member is supported at both ends thereof and co-axially arranged on a shaft of the pick-up roller or on shaft bearings that receive the shaft of the pick-up roller, and the cover member is provide with ribs; and a paper feeding cover, the paper feeding cover includes a plurality of ribs provided at an end on the placing table side of the paper feeding cover.

* * * * *